US010724228B2

(12) United States Patent
Collins et al.

(10) Patent No.: US 10,724,228 B2
(45) Date of Patent: Jul. 28, 2020

(54) BUILDING ASSEMBLIES AND METHODS FOR CONSTRUCTING A BUILDING USING PRE-ASSEMBLED FLOOR-CEILING PANELS AND WALLS

(71) Applicant: Innovative Building Technologies, LLC, Seattle, WA (US)

(72) Inventors: Arlan Collins, Seattle, WA (US); Mark Woerman, Seattle, WA (US); Mark D'Amato, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

(21) Appl. No.: 15/975,271

(22) Filed: May 9, 2018

(65) Prior Publication Data

US 2018/0328019 A1 Nov. 15, 2018

Related U.S. Application Data

(60) Provisional application No. 62/505,703, filed on May 12, 2017.

(51) Int. Cl.
*E04B 1/348* (2006.01)
*E04B 1/24* (2006.01)
(Continued)

(52) U.S. Cl.
CPC ..... *E04B 1/34853* (2013.01); *E04B 1/24* (2013.01); *E04B 1/34861* (2013.01); *E04B 1/40* (2013.01);
(Continued)

(58) Field of Classification Search
CPC ..... E04B 1/34853; E04B 1/34861; E04B 1/3483; E04B 2001/2478;
(Continued)

(56) References Cited

U.S. PATENT DOCUMENTS 1,168,556 A 1/1916 Robinson et al.
1,501,288 A 7/1924 Morley
(Continued)

FOREIGN PATENT DOCUMENTS

AU 2005200682 5/2005
AU 2012211472 2/2014
(Continued)

OTHER PUBLICATIONS

US 8,701,371 B2, 04/2014, Collins et al. (withdrawn)
(Continued)

*Primary Examiner* — Christine T Cajilig

(57) ABSTRACT

A building system may include at least one diaphragm beam having opposite ends connected to an external structural frame of a building, at least one pre-assembled floor-ceiling panel adjacent to a vertical side of and coupled to the diaphragm beam, and at least one pre-assembled wall adjacent to a horizontal side of and coupled to the diaphragm beam. The diaphragm beam may be filled with a mineral-based material, such as concrete. The one or more pre-assembled floor-ceiling panels may each include a plurality of joists extending perpendicular to the diaphragm beam, a floor-panel including at least one metal layer attached to the joists on a floor side of the pre-assembled floor-ceiling panel, and a ceiling panel including at least one layer comprising mineral-based material attached to the joists on a ceiling side of the pre-assembled floor-ceiling panel. The one or more pre-assembled walls may include interior and/or exterior walls of a building.

26 Claims, 13 Drawing Sheets

(51) Int. Cl.

| | |
|---|---|
| ***E04B 5/10*** | (2006.01) |
| ***E04B 5/02*** | (2006.01) |
| ***E04B 1/41*** | (2006.01) |
| ***E04C 2/52*** | (2006.01) |
| ***E04B 2/72*** | (2006.01) |
| ***E04B 2/74*** | (2006.01) |
| ***E04B 5/04*** | (2006.01) |
| ***E04B 5/12*** | (2006.01) |
| ***E04B 5/48*** | (2006.01) |
| ***E04C 3/29*** | (2006.01) |
| ***E04B 1/38*** | (2006.01) |
| ***E04C 3/28*** | (2006.01) |
| ***E04B 1/00*** | (2006.01) |

(52) U.S. Cl.
CPC ..... *E04B 2/721* (2013.01); *E04B 2/7409* (2013.01); *E04B 2/7457* (2013.01); *E04B 5/023* (2013.01); *E04B 5/026* (2013.01); *E04B 5/046* (2013.01); *E04B 5/10* (2013.01); *E04B 5/12* (2013.01); *E04B 5/48* (2013.01); *E04C 2/521* (2013.01); *E04B 1/003* (2013.01); *E04B 1/0023* (2013.01); *E04B 2001/2478* (2013.01); *E04B 2001/2484* (2013.01); *E04B 2001/2496* (2013.01); *E04B 2001/405* (2013.01); *E04B 2002/7477* (2013.01); *E04C 3/28* (2013.01); *E04C 3/29* (2013.01)

(58) Field of Classification Search
CPC .... E04B 2001/2484; E04B 5/10; E04B 5/023; E04B 5/026; E04B 5/046; E04C 2/521
See application file for complete search history.

(56) References Cited

U.S. PATENT DOCUMENTS 1,876,528 A 7/1931 Walters
1,883,376 A * 10/1932 Meier ..... E04B 1/24 52/654.1
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,722,724 A 11/1955 Miller
2,758,467 A 8/1956 Brown et al.
2,871,544 A * 2/1959 Youtz ..... E04B 1/35 52/745.13
2,871,997 A 2/1959 Simpson et al.
2,877,990 A 3/1959 Goemann
2,946,413 A 7/1960 Weismann
3,017,723 A 1/1962 Von Heidenstam
3,052,449 A 9/1962 Long et al.
3,053,015 A 9/1962 George
3,053,509 A 9/1962 Haupt et al.
3,065,575 A 11/1962 Ray
3,079,652 A 3/1963 Wahlfeld
3,090,164 A 5/1963 Nels
3,184,893 A 5/1965 Booth
3,221,454 A 12/1965 Giulio
3,235,917 A 2/1966 Skubic
3,236,014 A 2/1966 Edgar
3,245,183 A 4/1966 Tessin
3,281,172 A 10/1966 Kuehl
3,315,424 A 4/1967 Smith
3,324,615 A 6/1967 Zinn
3,324,617 A 6/1967 Knight et al.
3,355,853 A 12/1967 Wallace
3,376,919 A 4/1968 Agostino
3,388,512 A 6/1968 Newman
3,392,497 A 7/1968 Vantine
3,411,252 A 11/1968 Boyle, Jr.
3,460,302 A 8/1969 Cooper
3,490,191 A 1/1970 Ekblom
3,533,205 A 10/1970 Pestel et al.
3,568,380 A 3/1971 Stucky et al.
3,579,935 A 5/1971 Regan et al.
3,590,393 A 7/1971 Hollander
3,594,965 A 7/1971 Saether
3,601,937 A 8/1971 Campbell
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,750,366 A 8/1973 Rich, Jr. et al.
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,885,367 A 5/1975 Thunberg
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,018,020 A 4/1977 Sauer et al.
4,038,796 A 8/1977 Eckel
4,050,215 A 9/1977 Fisher
4,059,936 A 11/1977 Lukens
4,065,905 A 1/1978 Lely et al.
4,078,345 A 3/1978 Piazzalunga
4,107,886 A 8/1978 Ray
4,112,173 A 9/1978 Roudebush
4,114,335 A 9/1978 Carroll
4,142,255 A 3/1979 Togni
4,161,087 A 7/1979 Levesque
4,170,858 A 10/1979 Walker
4,171,545 A 10/1979 Kann
4,176,504 A 12/1979 Huggins
4,178,343 A 12/1979 Rojo, Jr.
4,205,719 A 6/1980 Norell et al.
4,206,162 A 6/1980 Vanderklaauw
4,214,413 A 7/1980 Gonzalez Espinosa de Los
4,221,441 A 9/1980 Bain
4,226,061 A 10/1980 Day, Jr.
4,227,360 A 10/1980 Balinski
4,248,020 A 2/1981 Zielinski et al.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu
4,441,286 A 4/1984 Skvaril
4,447,987 A 5/1984 Lesosky
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,531,336 A 7/1985 Gartner
4,592,175 A 6/1986 Werner
4,646,495 A 3/1987 Chalik
4,648,228 A 3/1987 Kiselewski
4,655,011 A 4/1987 Borges
4,688,750 A 8/1987 Teague et al.
4,712,352 A 12/1987 Low

(56) References Cited

U.S. PATENT DOCUMENTS 4,757,663 A 7/1988 Kuhr
4,856,244 A 8/1989 Clapp
4,862,663 A 9/1989 Krieger
4,893,435 A 1/1990 Shalit
4,910,932 A 3/1990 Honigman
4,918,897 A 4/1990 Luedtke
4,919,164 A 4/1990 Barenburg
4,974,366 A 12/1990 Tizzoni
4,991,368 A 2/1991 Amstutz
5,009,043 A 4/1991 Kurrasch
5,010,690 A 4/1991 Geoffrey
5,036,638 A 8/1991 Kurtz, Jr.
5,076,310 A 12/1991 Barenburg
5,079,890 A 1/1992 Kubik et al.
5,127,203 A 7/1992 Paquette
5,127,760 A 7/1992 Brady
5,154,029 A 10/1992 Sturgeon
5,185,971 A 2/1993 Johnson, Jr.
5,205,091 A 4/1993 Brown
5,212,921 A 5/1993 Unruh
5,228,254 A 7/1993 Honeycutt, Jr.
5,233,810 A 8/1993 Jennings
5,254,203 A 10/1993 Corston
5,307,600 A 5/1994 Simon, Jr.
5,359,816 A 11/1994 Iacouides
5,359,820 A 11/1994 McKay
5,361,556 A 11/1994 Menchetti
5,402,612 A 4/1995 diGirolamo et al.
5,412,913 A 5/1995 Daniels et al.
5,426,894 A 6/1995 Headrick
5,452,552 A 9/1995 Ting
5,459,966 A 10/1995 Suarez
5,471,804 A 12/1995 Winter, IV
5,483,773 A 1/1996 Parisien
5,493,838 A 2/1996 Ross
5,509,242 A 4/1996 Rechsteiner et al.
5,519,971 A 5/1996 Ramirez
5,528,877 A 6/1996 Franklin
5,531,539 A 7/1996 Crawford
5,584,142 A 12/1996 Spiess
5,592,796 A 1/1997 Landers
5,593,115 A 1/1997 Lewis
5,611,173 A 3/1997 Headrick et al.
5,628,158 A 5/1997 Porter
5,640,824 A 6/1997 Johnson
5,660,017 A * 8/1997 Houghton ..... E04B 1/2403 52/167.3
5,678,384 A 10/1997 Maze
5,697,189 A 12/1997 Miller
5,699,643 A 12/1997 Kinard
5,706,607 A 1/1998 Frey
5,724,773 A 3/1998 Hall
5,735,100 A 4/1998 Campbell
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,970,680 A 10/1999 Powers
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A 6/2000 Tongiatama
6,076,319 A 6/2000 Hendershot
6,086,350 A 7/2000 Del Monte
6,128,877 A 10/2000 Goodman et al.
6,151,851 A 11/2000 Carter
6,154,774 A 11/2000 Furlong
6,170,214 B1 1/2001 Treister et al.
6,240,704 B1 6/2001 Porter
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk
6,393,774 B1 5/2002 Fisher
6,421,968 B2 7/2002 Degelsegger
6,427,407 B1 8/2002 Wilson
6,430,883 B1 8/2002 Paz et al.
6,446,396 B1 9/2002 Marangoni et al.
6,481,172 B1 11/2002 Porter
6,484,460 B2 11/2002 VanHaitsma
6,571,523 B2 6/2003 Chambers
6,625,937 B1 9/2003 Parker
6,651,393 B2 11/2003 Don
6,688,056 B2 2/2004 Von Hoyningen Huene et al.
6,729,094 B1 5/2004 Spencer et al.
6,748,709 B1 6/2004 Sherman et al.
6,807,790 B2 10/2004 Strickland et al.
6,837,013 B2 1/2005 Foderberg et al.
6,922,960 B2 8/2005 Sataka
6,935,079 B1 8/2005 Julian et al.
6,964,410 B1 11/2005 Hansen
7,007,343 B2 3/2006 Weiland
7,059,017 B1 6/2006 Rosko
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,329 B2 2/2009 Fiehler
7,484,339 B2 2/2009 Fiehler
7,493,729 B1 2/2009 Semmes
7,546,715 B2 6/2009 Roen
7,574,837 B2 8/2009 Hagen, Jr. et al.
7,658,045 B2 2/2010 Elliott et al.
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
7,941,985 B2 5/2011 Simmons
7,966,778 B2 6/2011 Klein
8,051,623 B2 11/2011 Loyd
D652,956 S 1/2012 Tanaka et al.
8,096,084 B2 1/2012 Studebaker et al.
8,109,058 B2 2/2012 Miller
8,127,507 B1 3/2012 Bilge
8,166,716 B2 5/2012 Macdonald et al.
8,234,827 B1 8/2012 Schroeder, Sr.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner
8,505,259 B1 8/2013 Degtyarev
8,539,732 B2 9/2013 Leahy
8,555,581 B2 10/2013 Amend
8,555,589 B2 10/2013 Semmens et al.
8,555,598 B2 10/2013 Wagner et al.
8,621,806 B2 1/2014 Studebaker et al.
8,621,818 B1 1/2014 Glenn et al.
8,631,616 B2 1/2014 Carrion et al.
8,733,046 B2 5/2014 Naidoo
8,769,891 B2 7/2014 Kelly
8,826,613 B1 9/2014 Chrien
8,833,025 B2 9/2014 Krause
8,950,132 B2 2/2015 Collins et al.
8,966,845 B1 3/2015 Ciuperca
8,978,324 B2 3/2015 Collins et al.
8,991,111 B1 3/2015 Harkins

(56) References Cited

U.S. PATENT DOCUMENTS 8,997,424 B1 4/2015 Miller
9,027,307 B2 5/2015 Collins et al.
9,382,709 B2 7/2016 Collins et al.
9,637,911 B2 5/2017 Doupe et al.
9,683,361 B2 6/2017 Timberlake et al.
10,041,289 B2 8/2018 Collins et al.
10,273,686 B2 4/2019 Lake
10,323,428 B2 6/2019 Collins et al.
10,370,851 B2 8/2019 Bodwell et al.
10,501,929 B2 12/2019 Henry
2002/0059763 A1 5/2002 Wong
2002/0092703 A1 7/2002 Gelin et al.
2002/0134036 A1 9/2002 Daudet et al.
2002/0170243 A1 11/2002 Don
2002/0184836 A1* 12/2002 Takeuchi ..... E04B 1/2403 52/167.1
2003/0005653 A1 1/2003 Sataka
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0167719 A1 9/2003 Alderman
2003/0200706 A1* 10/2003 Kahan ..... E04H 9/02 52/167.3
2003/0221381 A1 12/2003 Ting
2004/0065036 A1 4/2004 Capozzo
2004/0103596 A1 6/2004 Don
2004/0221518 A1 11/2004 Westra
2005/0081484 A1 4/2005 Yland
2005/0108957 A1 5/2005 Quesada
2005/0188626 A1 9/2005 Johnson
2005/0188632 A1 9/2005 Rosen
2005/0198919 A1 9/2005 Hester, Jr.
2005/0204697 A1 9/2005 Rue
2005/0204699 A1 9/2005 Rue
2005/0210764 A1 9/2005 Foucher et al.
2005/0210798 A1 9/2005 Burg et al.
2005/0235571 A1 10/2005 Ewing et al.
2005/0235581 A1 10/2005 Cohen
2005/0247013 A1 11/2005 Walpole
2005/0262771 A1 12/2005 Gorman
2006/0021289 A1 2/2006 Elmer
2006/0070321 A1 4/2006 Au
2006/0090326 A1 5/2006 Corbett
2006/0096202 A1 5/2006 Delzotto
2006/0117689 A1 6/2006 Onken et al.
2006/0137293 A1 6/2006 Klein
2006/0143856 A1 7/2006 Rosko et al.
2006/0150521 A1 7/2006 Henry
2006/0179764 A1 8/2006 Ito
2006/0248825 A1 11/2006 Garringer
2007/0000198 A1 1/2007 Payne
2007/0074464 A1 4/2007 Eldridge
2007/0107349 A1 5/2007 Erker
2007/0157539 A1 7/2007 Knigge et al.
2007/0163197 A1 7/2007 Payne et al.
2007/0209306 A1 9/2007 Andrews et al.
2007/0234657 A1 10/2007 Speyer et al.
2007/0251168 A1 11/2007 Turner
2007/0283640 A1 12/2007 Shivak et al.
2007/0294954 A1 12/2007 Barrett
2008/0000177 A1 1/2008 Siu
2008/0057290 A1 3/2008 Guevara et al.
2008/0092472 A1 4/2008 Doerr et al.
2008/0098676 A1 5/2008 Hutchens
2008/0099283 A1 5/2008 Reigwein
2008/0104901 A1 5/2008 Olvera
2008/0168741 A1 7/2008 Gilgan
2008/0178542 A1 7/2008 Williams
2008/0178642 A1 7/2008 Sanders
2008/0190053 A1 8/2008 Surowiecki
2008/0202048 A1 8/2008 Miller et al.
2008/0222981 A1 9/2008 Gobbi
2008/0229669 A1 9/2008 Abdollahzadeh et al.
2008/0245007 A1 9/2008 McDonald
2008/0282626 A1 11/2008 Powers, Jr.
2008/0289265 A1 11/2008 Lessard
2008/0295443 A1 12/2008 Simmons
2008/0295450 A1 12/2008 Yogev
2009/0031652 A1 2/2009 Ortega Gatalan
2009/0038764 A1 2/2009 Pilz
2009/0064611 A1 3/2009 Hall et al.
2009/0077916 A1 3/2009 Scuderi et al.
2009/0090074 A1 4/2009 Klein
2009/0100760 A1 4/2009 Ewing
2009/0100769 A1 4/2009 Barrett
2009/0100796 A1 4/2009 Denn et al.
2009/0107065 A1 4/2009 LeBlang
2009/0113820 A1 5/2009 Deans
2009/0134287 A1 5/2009 Klosowski
2009/0165399 A1 7/2009 Campos Gines
2009/0188192 A1 7/2009 Studebaker et al.
2009/0188193 A1 7/2009 Studebaker et al.
2009/0205277 A1 8/2009 Gibson
2009/0249714 A1 10/2009 Combs et al.
2009/0277122 A1 11/2009 Howery et al.
2009/0282766 A1 11/2009 Roen
2009/0283359 A1 11/2009 Ravnaas
2009/0293395 A1 12/2009 Porter
2009/0313931 A1 12/2009 Porter
2010/0050556 A1 3/2010 Burns
2010/0058686 A1 3/2010 Henriquez
2010/0064590 A1 3/2010 Jones et al.
2010/0064601 A1 3/2010 Napier
2010/0146874 A1 6/2010 Brown
2010/0146893 A1 6/2010 Dickinson
2010/0186313 A1 7/2010 Stanford et al.
2010/0212255 A1 8/2010 Lesoine
2010/0218443 A1 9/2010 Studebaker
2010/0229472 A1 9/2010 Malpas
2010/0235206 A1 9/2010 Miller et al.
2010/0263308 A1 10/2010 Olvera
2010/0275544 A1 11/2010 Studebaker et al.
2010/0313518 A1 12/2010 Berg
2010/0325971 A1 12/2010 Leahy
2010/0325989 A1 12/2010 Leahy
2011/0023381 A1 2/2011 Weber
2011/0041411 A1 2/2011 Aragon
2011/0056147 A1 3/2011 Beaudet
2011/0113709 A1 5/2011 Pilz
2011/0113715 A1 5/2011 Tonyan et al.
2011/0126484 A1 6/2011 Carrion et al.
2011/0146180 A1 6/2011 Klein et al.
2011/0154766 A1 6/2011 Kralic et al.
2011/0162167 A1 7/2011 Blais
2011/0219720 A1 9/2011 Strickland et al.
2011/0247281 A1 10/2011 Pilz et al.
2011/0268916 A1 11/2011 Pardue, Jr.
2011/0296769 A1* 12/2011 Collins ..... E04B 1/003 52/79.1
2011/0296778 A1 12/2011 Collins et al.
2011/0296789 A1 12/2011 Collins et al.
2011/0300386 A1 12/2011 Pardue, Jr.
2012/0073227 A1 3/2012 Urusoglu
2012/0096800 A1 4/2012 Berg
2012/0137610 A1 6/2012 Knight et al.
2012/0151869 A1 6/2012 Miller
2012/0167505 A1 7/2012 Krause
2012/0186174 A1 7/2012 LeBlang
2012/0210658 A1 8/2012 Logan
2012/0291378 A1 11/2012 Schroeder et al.
2012/0297712 A1 11/2012 Lutzner et al.
2012/0317923 A1 12/2012 Herdt et al.
2013/0025222 A1 1/2013 Mueller
2013/0025966 A1 1/2013 Nam et al.
2013/0036688 A1 2/2013 Gosain
2013/0067832 A1* 3/2013 Collins ..... E04B 1/24 52/125.1
2013/0111840 A1 5/2013 Bordener
2013/0133277 A1 5/2013 Lewis
2013/0232887 A1 9/2013 Donnini
2014/0013678 A1 1/2014 Deverini
2014/0013684 A1 1/2014 Kelly et al.

(56) References Cited

U.S. PATENT DOCUMENTS

| | | | | |
|---|---|---|---|---|
| 2014/0013695 | A1 | 1/2014 | Wolynski et al. | |
| 2014/0047780 | A1 | 2/2014 | Quinn et al. | |
| 2014/0059960 | A1 | 3/2014 | Cole | |
| 2014/0069035 | A1 | 3/2014 | Collins et al. | |
| 2014/0069040 | A1 | 3/2014 | Gibson | |
| 2014/0069050 | A1 | 3/2014 | Bolin | |
| 2014/0083046 | A1 | 3/2014 | Yang | |
| 2014/0090323 | A1 | 4/2014 | Glancy | |
| 2014/0130441 | A1 | 5/2014 | Sugihara et al. | |
| 2014/0317841 | A1 | 10/2014 | Dejesus et al. | |
| 2014/0338280 | A1 | 11/2014 | Tanaka et al. | |
| 2015/0007415 | A1 | 1/2015 | Kalinowski | |
| 2015/0093184 | A1 | 4/2015 | Henry | |
| 2015/0096251 | A1 | 4/2015 | McCandless et al. | |
| 2015/0128518 | A1 | 5/2015 | Knight et al. | |
| 2015/0136361 | A1 | 5/2015 | Gregory | |
| 2015/0152634 | A1 | 6/2015 | Unger | |
| 2015/0211227 | A1 | 7/2015 | Collins et al. | |
| 2015/0233108 | A1 | 8/2015 | Eggleston, II et al. | |
| 2015/0252558 | A1 | 9/2015 | Chin | |
| 2015/0284950 | A1 | 10/2015 | Stramandinoli | |
| 2015/0297926 | A1* | 10/2015 | Dzegan | A62C 35/58 169/56 |
| 2015/0308096 | A1* | 10/2015 | Merhi | B66D 3/18 52/125.1 |
| 2016/0002912 | A1 | 1/2016 | Doupe et al. | |
| 2016/0053475 | A1 | 2/2016 | Locker et al. | |
| 2016/0122996 | A1 | 5/2016 | Timberlake et al. | |
| 2016/0145933 | A1 | 5/2016 | Condon et al. | |
| 2016/0258160 | A1* | 9/2016 | Radhouane | E04C 3/29 |
| 2016/0290030 | A1 | 10/2016 | Collins et al. | |
| 2016/0319534 | A1 | 11/2016 | Bernardo | |
| 2017/0037613 | A1 | 2/2017 | Collins et al. | |
| 2017/0284095 | A1 | 10/2017 | Collins et al. | |
| 2017/0299198 | A1 | 10/2017 | Collins et al. | |
| 2017/0306624 | A1 | 10/2017 | Graham et al. | |
| 2017/0306625 | A1 | 10/2017 | Collins et al. | |
| 2018/0038103 | A1 | 2/2018 | Neumayr | |
| 2018/0148926 | A1 | 5/2018 | Lake | |
| 2018/0209136 | A1 | 7/2018 | Aylward et al. | |
| 2018/0223521 | A1 | 8/2018 | Uno et al. | |
| 2018/0328056 | A1 | 11/2018 | Collins et al. | |
| 2019/0032327 | A1 | 3/2019 | Musson | |
| 2019/0119908 | A1 | 4/2019 | Petricca | |
| 2019/0136508 | A1 | 5/2019 | Chaillan | |
| 2019/0249409 | A1 | 8/2019 | Boyd et al. | |

FOREIGN PATENT DOCUMENTS

| | | |
|---|---|---|
| CN | 1313921 | 9/2001 |
| CN | 1234087 | 11/2002 |
| CN | 1742144 | 3/2006 |
| CN | 20137279 | 3/2008 |
| CN | 101426986 | 5/2009 |
| CN | 101821462 | 9/2010 |
| CN | 101831963 | 9/2010 |
| CN | 102105642 | 6/2011 |
| CN | 201952944 | 8/2011 |
| CN | 202117202 | 1/2012 |
| CN | 102459775 | 5/2012 |
| CN | 102587693 | 7/2012 |
| CN | 202299241 | 7/2012 |
| CN | 202391078 | 8/2012 |
| CN | 102733511 | 10/2012 |
| CN | 205024886 | 2/2016 |
| CN | 108487464 | 9/2018 |
| DE | 4205812 | 9/1993 |
| DE | 9419429 | 2/1995 |
| DE | 20002775 | 8/2000 |
| DE | 19918153 | 11/2000 |
| DE | 20315506 | 11/2004 |
| DE | 202008007139 | 10/2009 |
| EP | 0612896 | 8/1994 |
| EP | 1045078 | 10/2000 |
| EP | 0235029 | 2/2002 |
| EP | 1375804 | 1/2004 |
| EP | 2128353 | 12/2009 |
| EP | 2213808 | 8/2010 |
| EP | 2238872 | 10/2010 |
| EP | 1739246 | 1/2011 |
| EP | 2281964 | 2/2011 |
| EP | 3133220 | 2/2017 |
| FR | 1317681 | 5/1963 |
| FR | 2988749 | 10/2013 |
| FR | 2765906 | 1/2019 |
| GB | 898905 | 6/1962 |
| GB | 2481126 | 12/2011 |
| JP | S46-006980 | 12/1971 |
| JP | S49-104111 | 9/1974 |
| JP | 52-015934 | 4/1977 |
| JP | 53-000014 | 1/1978 |
| JP | 53-156364 | 12/1978 |
| JP | 54-084112 | 6/1979 |
| JP | S54-145910 | 11/1979 |
| JP | 56-131749 | 10/1981 |
| JP | 57-158451 | 9/1982 |
| JP | S59-065126 | 5/1984 |
| JP | S60-019606 | 2/1985 |
| JP | 61-144151 | 9/1986 |
| JP | S61-201407 | 12/1986 |
| JP | H01-153013 | 10/1989 |
| JP | H0310985 | 1/1991 |
| JP | H049373 | 3/1992 |
| JP | 6-12178 | 2/1994 |
| JP | H06220932 | 8/1994 |
| JP | H07-173893 | 7/1995 |
| JP | H0752887 | 12/1995 |
| JP | 8-189078 | 7/1996 |
| JP | H08189078 | 7/1996 |
| JP | H09228510 | 9/1997 |
| JP | 2576409 | 4/1998 |
| JP | 10234493 | 9/1998 |
| JP | 11-117429 | 4/1999 |
| JP | H11-100926 | 4/1999 |
| JP | 2000-34801 | 2/2000 |
| JP | 2000144997 | 5/2000 |
| JP | 2000-160861 | 6/2000 |
| JP | 3137760 | 2/2001 |
| JP | 3257111 | 2/2002 |
| JP | 2002-309691 | 10/2002 |
| JP | 2002536615 | 10/2002 |
| JP | 2002364104 | 12/2002 |
| JP | 2003-505624 | 2/2003 |
| JP | 2003-278300 | 10/2003 |
| JP | 2003-293493 | 10/2003 |
| JP | 2003278300 | 10/2003 |
| JP | 2004108031 | 4/2004 |
| JP | 2004-344194 | 12/2004 |
| JP | 3664280 | 6/2005 |
| JP | 2006-161406 | 6/2006 |
| JP | 2008-063753 | 3/2008 |
| JP | 2008073434 | 4/2008 |
| JP | 2008110104 | 5/2008 |
| JP | 2009-257713 | 11/2009 |
| JP | 2010-185264 | 8/2010 |
| JP | 2010245918 | 10/2010 |
| JP | 2011-032802 | 2/2011 |
| JP | 2011032802 | 2/2011 |
| JP | 3187449 | 11/2013 |
| JP | 2015-117502 | 6/2015 |
| KR | 1019990052255 | 7/1999 |
| KR | 1019990053902 | 7/1999 |
| KR | 100236196 | 12/1999 |
| KR | 102000200413000 | 10/2000 |
| KR | 20060066931 | 6/2006 |
| KR | 20080003326 | 8/2008 |
| KR | 101481790 | 1/2015 |
| KR | 20180092677 | 8/2018 |
| WO | 1991007557 | 5/1991 |
| WO | 1997022770 | 6/1997 |
| WO | 200046457 | 8/2000 |
| WO | 0058583 | 10/2000 |
| WO | 2002/035029 | 5/2002 |

(56) References Cited

FOREIGN PATENT DOCUMENTS

| | | | | |
|---|---|---|---|---|
| WO | 2002035029 | | 5/2002 | |
| WO | WO-2006091864 | A2 * | 8/2006 | ..... E04C 2/044 |
| WO | 2007059003 | | 5/2007 | |
| WO | 2007080561 | | 7/2007 | |
| WO | 2010030060 | | 3/2010 | |
| WO | 2010037938 | | 4/2010 | |
| WO | WO-2011015681 | A2 * | 2/2011 | ..... E04C 3/292 |
| WO | 2015050502 | | 4/2015 | |
| WO | 2016/033429 | | 3/2016 | |
| WO | 2016032537 | | 3/2016 | |
| WO | 2016032538 | | 3/2016 | |
| WO | 2016032539 | | 3/2016 | |
| WO | 2016032540 | | 3/2016 | |
| WO | 2016033429 | | 3/2016 | |
| WO | 2016033525 | | 3/2016 | |
| WO | WO-2016032538 | A1 * | 3/2016 | ..... E04H 9/024 |
| WO | WO-2016032540 | A1 * | 3/2016 | ..... E04B 1/14 |

OTHER PUBLICATIONS

EPO, Extended European Search Report for European Patent Application No. 17763913.5, dated Oct. 16, 2019, 8 pages.
EPO, Partial European Search Report for European Patent Application No. 177639101, dated Oct. 17, 2019, 16 pages.
EPO, Extended European Search Report for European Patent Application No. 17763907.7, dated Sep. 13, 2019, 13 pages.
WIPO, "International Search Report and Written Opinion for PCT Application No. PCT/US2019/038557", dated Sep. 4, 2019, 67 pages.
EPO, European Search Report in PCT/US2015/047383 dated Jun. 22, 2018, 10 Pages.
WIPO, International Search Report and Written opinion for International Application No. PCT/US/2014/053614 dated Dec. 18, 2014, 11 pages.
WIPO, International Search Report and Written opinion for International Application No. PCT/US/2014/053615 dated Dec. 17, 2014, 11 pages.
WIPO, International Search Report and Written opinion for International Application No. PCT/US/2014/053613 dated Dec. 18, 2014, 13 Pages.
WIPO, International Search Report and Written Opinion for International Application No. PCT/US2011/001039 dated Oct. 5, 2011, 14 Pages.
WIPO, International Search Report and Written opinion for International Application No. PCT/US2015/047383 dated Jan. 12, 2016, 14 Pages.
WIPO, International Search Report and Written opinion for International Application No. PCT/US15/47536 dated Dec. 4, 2015, 17 Pages.
EPO, European Search Report received for POT 14891125.8—1604/3011122 dated Jul. 8, 2016, 4 pages.
WIPO, International Search Report and Written opinion for International Application No. PCT/US/2014/053616 dated Dec. 17, 2014, 9 Pages.
WIPO, International Search Report and Written Opinion for PCT Application No. PCT/US2011/001039 dated Oct. 5, 2011, 9 Pages.
"Beam to column connection", TATA Steel, http://www.tatasteelconstruction.com/en/reference/teaching_resources/architectural_studio_reference/elements/connections/beam to column connections, 2014, 4 Pages.
"Emerging Trends 2012 Executive Summary", Urban Land Institute, Ch. 1, 2011, 1-11 Pages.
"Emerging Trends in real estate", accessed on Sep. 15, 2016 at https://web.archive.orglweb120140813084823/http://pwc.corn.au/industry/real-estate/assets/Real-Estate-2012-Europe-Jan12.pdf, pp. 60 (2012).
EPO, "Extended European Search Report for European Application No. Ep 15836516.3", dated Jun. 22, 2018, 1 page.
EPO, "Extended European Search Report for European Patent Application No. 14900469", dated Mar. 20, 2018, 1-8.
"How to Soundproof a Ceiling—Soundproofing Ceilings", http://www.soundproofingcompany.com/soundproofing-solutions/soundproof-a-ceiling/, Apr. 2, 2014, 1-7 Pages.
"Insulspan Installation Guide", Obtained at: http://www.insuispan.comidownloads:InstallationGuide,pdf on Feb. 2, 2016, 58 pages.
"Structural Insulated Panel", Wikipedia, http://www.en.wikipedia.org//wiki/Structural_insulated_panel, May 30, 2014, 5 Pages.
"Structural Insulated Panels", SIP Solutions, http://www.sipsolutions.com/content/structuralinsulated-panels, Aug. 15, 2014, 3 pages.
"US Apartment & Condominium Construction Forecast 2003-2017", Statista, Inc., Jun. 2012, 8 Pages.
Azari, et al., "Modular Prefabricated Residential Construction—Constraints and Opportunities", PNCCRE Technical Report #TR002, Aug. 2013, 90 Pages.
Borzouie, Jamaledin, et al., "Seismic Assesment and Reahbilitation of Diaphragms", http://www.nosazimadares.ir/behsazi/15WCEE2012/URM/1/Roof.pdf, Dec. 31, 2011, 86 Pages.
EPO, Communication Pursuant to Article 94(3) EPC mailed for EP application No. 15836516.3, dated Apr 25, 2019, 4 pages.
EPO, Communication Pursuant to Article 94(3) EPC for European Patent Application No. 15836516.3, dated Aug. 2, 2019, 4 pages.
EPO, Communication Pursuant to Article 94(3) EPC mailed for European patent application No. 14900469.9, dated Jun. 18, 2019, 5 pages.
FRAMECAD, "FC EW 1-12mm Fibre Cement Sheet + 9mm MgO Board Wall Assembly", 2013, 2 pages.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 2006, 1-15 Pages.
Gonchar, "Paradigm Shift—Multistory Modular", Architectural Record, Oct. 2012, 144-148 Pages.
Kerin, et al., "National Apartment Market Report—2013", Marcus & Millichap, 2013, 1-9 pages.
M.A. Riusillo, "Lift Slab Construction: Its History, Methodology, Economics and Applications", ACI-Abstract, Jun. 1, 1988, 2 pages.
Mcilwain, "Housing in America—The Next Decade", Urban Land Institute, 2010, 1-28 Pages.
Mcilwain, "The Rental Boost From Green Design", Urban Land, http://urbanland.uli.org/sustainability/the-rental-boost-from-green-design/, Jan. 4, 2012, 1-6 Pages.
Shashaty, Andre, "Housing Demand", Sustainable Communities, Apr. 2011, 14-18 Pages.
Sichelman, "Severe Apartment Shortage Looms", Urban Land, http://urbanland.uli.org/capital-markets/nahb-orlando-severe-apartment shortage-looms/, Jan. 13, 2011, 1-2 Pages.
Stiemer, S F, "Bolted Beam-Column Connections", http://faculty.philau.edu/pastorec/Tensile/bolted_beam_colummn_connections.pdf, Nov. 11, 2007, 1-16 Pages.
WIPO, International Search Report for International Patent Application No. PCT/US2017/021174, dated Jun. 26, 2017, 11 pages.
WIPO, International Search Report for International Patent Application No. PCT/US2017/021168, dated May 19, 2017, 5 pages.
WIPO, Written Opinion for International Patent Application No. PCT/US2017/021174, dated Jun. 26, 2017, 6 pages.
WIPO, International Search Report for International Patent Application No. PCT/US2017/021179, dated May 25, 2017, 7 pages.
WIPO, Written Opinion for International Patent Application No. PCT/US2017/021179, dated May 25, 2017, 7 pages.
WIPO, International Search Report of International Patent Application No. PCT/US2017/021177, dated Jun. 5, 2017, 8 pages.
WIPO, Written Opinion of International Patent Application No. PCT/US2017/021177, dated Jun. 5, 2017, 8 pages.
WIPO, Written Opinion for International Patent Application No. PCT/US2017/021168, dated May 19, 2017, 8 pages.
WIPO, International Search Report and Written Opinion mailed for International application No. PCT/US2019/031370, dated Aug. 7, 2019, 11 pages.
WIPO, International Search Report and Written Opinion mailed for International application No. PCT/US2015/047536 dated Dec. 4, 2015, 17 Pages.

(56) References Cited

OTHER PUBLICATIONS

EPO, Communication Pursuant to Article 94(3) EPC for European Patent Application No. 15836516.3, dated Jan. 15, 2020, 5 pages.
EPO, Extended European Search Report for European Patent Application No. 17763910.1, dated Jan. 28, 2020, 13 pages.
EPO, Extended European Search Report for European Patent Application No. 17763914.3, dated Nov. 19, 2019, 10 pages.

* cited by examiner

BUILDING ASSEMBLIES AND METHODS FOR CONSTRUCTING A BUILDING USING PRE-ASSEMBLED FLOOR-CEILING PANELS AND WALLS

CROSS-REFERENCE TO RELATED APPLICATION

The present application is a non-provisional application that claims priority under 35 U.S.C. § 119(e) to U.S. Provisional Patent Application No. 62/505,703, filed on May 12, 2017, entitled "BUILDING SYSTEM WITH A DIAPHRAGM PROVIDED BY PRE-FABRICATED FLOOR PANELS," which is incorporated herein by reference in its entirety.

BACKGROUND

Conventional construction is mostly conducted in the field at the building job site. People in various trades (e.g., carpenters, electricians, and plumbers) measure, cut, and install material as though each unit were one-of-a-kind. Furthermore, activities performed by the trades are arranged in a linear sequence. The result is a time-consuming process that increases the risk of waste, installation imperfections, and cost overruns. One approach to improving efficiency in building construction may be modular construction. In the case of buildings with multiple dwelling units (e.g., apartments, hotels, student dorms, etc.), entire dwelling units (referred to as modules) may be built off-site in a factory and then trucked to the job site. The modules are then stacked and connected together, generally resulting in a low-rise construction (e.g., between one and six stories). Other modular construction techniques may involve the building of large components of the individual units off-site (e.g., in a factory) and assembling the large components in the field to reduce the overall construction effort at the job site and thereby reducing the overall time of erecting the building. However, shortcomings may exist with known modular building technologies and improvements thereof may be desirable.

SUMMARY

Techniques are generally described that include systems and methods relating to building construction and more specifically relating to building assemblies for constructing a building using pre-assembled floor-ceiling panels and walls. The pre-assembled floor-ceiling panels may form part of a diaphragm of the building while one or more of the pre-assembled walls may be coupled to the diaphragm such that they are non-loadbearing.

A building assembly according to some embodiments of the present disclosure may include at least one diaphragm beam having opposite ends connected to an external structural frame of a building, at least one pre-assembled floor-ceiling panel adjacent to a vertical side of and coupled to the diaphragm beam, and at least one pre-assembled wall adjacent to a horizontal side of and coupled to the diaphragm beam. In some embodiments, the diaphragm beam may be filled with a mineral-based material, for example concrete. In some embodiments, the diaphragm beam may include at least one reinforcing member embedded in the mineral-based material. For example, the reinforcing member may be an elongate metal rod (e.g., rebar) which extends along at least a portion of, and in some cases along the full length, of the diaphragm beam. The diaphragm beam may provide support for a diaphragm, which may be constructed using one or more pre-assembled floor-ceiling panel and one or more diaphragm beams, and may thus provide a load path for transmitting load from the diaphragm to an external structural frame of a building. The one or more pre-assembled floor-ceiling panels may each include a plurality of joists extending perpendicular to the diaphragm beam, a floor-panel including at least one metal layer attached to the joists on a floor side of the pre-assembled floor-ceiling panel, and a ceiling panel including at least one layer comprising mineral-based material attached to the joists on a ceiling side of the pre-assembled floor-ceiling panel.

In some embodiments, the ceiling side of the at least one pre-assembled floor-ceiling panel may be above the lower horizontal side of the diaphragm beam. In some embodiments, the floor side of the at least one pre-assembled floor-ceiling panel may be above the upper horizontal side of the diaphragm beam. In some embodiments, the building assembly may include at least two pre-assembled floor panels, each of which is adjacent to an opposite vertical side of the diaphragm beam. Each of the two pre-assembled floor panel may be coupled to an upper horizontal side of the diaphragm beam. In some embodiments, each of the two pre-assembled floor panel may be supported by a horizontally extending bracket attached to the respective vertical side of the diaphragm beam.

In some embodiments, the building assembly may include at least two pre-assembled walls adjacent to opposite horizontal sides of the diaphragm beam. In some embodiments, the at least two pre-assembled walls may be interior walls. In other embodiments, the at least two pre-assembled walls may be envelope walls. In some embodiments, the at least two pre-assembled walls, whether interior or exterior (envelope) walls, may be non-loadbearing walls. As described herein, building or structural loads may be carried by in part by the external structural frame and the diaphragm and not by the walls which define the units or rooms of the building.

In some embodiments, the one or more pre-assembled walls may include a plurality of studs extending perpendicular to the diaphragm beam and a pair of wall panels attached to opposite sides of the studs, brackets attached to an outer side of at least one of the pair of wall panels and configured to support an interior finish layer in a spaced arrangement from the respective outer side, and a sprinkler conduit extending through a cavity defined between the wall panels and protruding beyond the outer side of the at least one of the pair of wall panels to which the brackets are attached. In some embodiments, the pre-assembled wall may include an interior finish layer on each of the outer sides of the pair of wall panels, for example in the case of the pre-assembled wall being an interior or demising wall. The outer sides of the pair of wall panels may define a first distance therebetween, which is narrower than a width of the diaphragm beam, and the interior finish layers may define a second distance therebetween, which is wider than the width of the diaphragm beam and or wider than the distance between the opposing floor panels. In this manner, the finish side of the interior wall may be coupled with the floor side of the floor-ceiling panel in an aesthetically pleasing manner.

In some embodiments, the one or more pre-assembled walls may be non-rigidly coupled to the diaphragm beam, which may avoid or reduce the transference of structural loads to a non-loadbearing wall. In some embodiments, the non-rigid connection between the diaphragm beam and the wall may be achieved using a compressible material and/or a slidable joint between the pre-assembled wall and the diaphragm beam. For example, the diaphragm beam may include at least one bracket extending vertically from a lower horizontal side of the diaphragm beam, the bracket having a slot for forming a non-rigid connection with an upper portion of the pre-assembled wall. In some embodiments, such as in the case of an interior wall, the diaphragm beam may include at least two brackets extending vertically from a lower horizontal side of the diaphragm beam, each of the two brackets arranged to be positioned on opposite sides of the studs of the wall. That is, each of the brackets may be coupled to the diaphragm beam such as to accommodate a stud of the pre-assembled wall therebetween.

In some embodiments, the pre-assembled wall may be a first pre-assembled wall and the building assembly may include a second pre-assembled wall, which is coupled perpendicularly to first pre-assembled wall. The second pre-assembled wall may be an envelope wall (e.g., include exterior cladding material on one side and an interior finish layer on the opposite interior side). This second pre-assembled wall may also include plumbing conduits and may thus be referred to as a utility wall. In some embodiments, two such utility walls may be arranged on opposite sides of an interior or demising wall. The interior or demising wall may extend between the two utility walls, for example through a portion or substantially all of a space defined between two adjacent utility walls, which may improve the acoustic insulation between adjacent units or rooms. The interior wall may include one or more layers of insulation and may be additionally configured to accommodate insulative material in the space between the interior wall and the opposing sides of the two utility walls, which may further improve the acoustic insulation between the units or rooms located on the opposite sides of the demising wall.

In some embodiments, for example when the diaphragm beam is arranged to support an envelope wall, a water-impermeable elongate member may be coupled to the diaphragm beam in a manner to cover the vertical side of the diaphragm beam opposite the vertical side to which the floor-ceiling panel is attached. The water-impermeable member may thus be used to seal the envelope, e.g., by waterproofing and/or thermally sealing the joint between upper and lower exterior or envelope walls. The water-impermeable member may extend substantially along the full length of the diaphragm beam. In some examples, the water-impermeable member may be fabricated as an extrusion or a pultrusion formed of a plastic or composite material (e.g., a fiber reinforced plastic (FRP)). In some embodiments, the elongate member may cover at least a portion of the upper and/or lower horizontal sides of the diaphragm beam. In some embodiments, the elongate member may include a vertically extending flange configured to be received between an exterior cladding layer and a stud of the pre-assembled wall. In some embodiments, the elongate member may be coupled to the diaphragm beam such that it defines a cavity between the elongate member. The cavity may provide thermal insulation. For example, the cavity may contain a thermally-insulative material such as semi-rigid mineral wool, a thermal blanket material or the like.

A building assembly in accordance with further embodiments of the present disclosure may include a pair of diaphragm beams, each filled with a mineral-based material and each having opposite ends connected to an external structural frame of a building, a pre-assembled floor-ceiling panel arranged between and coupled to the pair of diaphragm beams, a first pre-assembled wall coupled to a horizontal side of one of the first and second diaphragm beams, wherein the first pre-assembled wall is an interior wall of the building, and a second pre-assembled wall coupled to a horizontal side of the other one of the first and second diaphragm beams, wherein the second pre-assembled wall is an envelope wall of the building. In some embodiments of the building assembly, the pre-assembled floor-ceiling panel may be one of a plurality of pre-assembled floor-ceiling panels extending between the first and second pre-assembled walls. In some embodiments, the building assembly may further include another pre-assembled wall connecting the first and second pre-assembled walls and which includes one or more plumbing conduits. In yet further embodiments, the pair of diaphragm beams may be a first pair of diaphragm beams and the building assembly may include at least one second pair of diaphragm beams coupled to the external structural frame at a vertical location above the first and second pre-assembled walls, for example to define another story of the building. In some such embodiments, the pre-assembled utility wall may be tall enough to span more than a singly story, e.g., it may extend from below the first pair of diaphragm beams to above the second pair of diaphragm beams.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
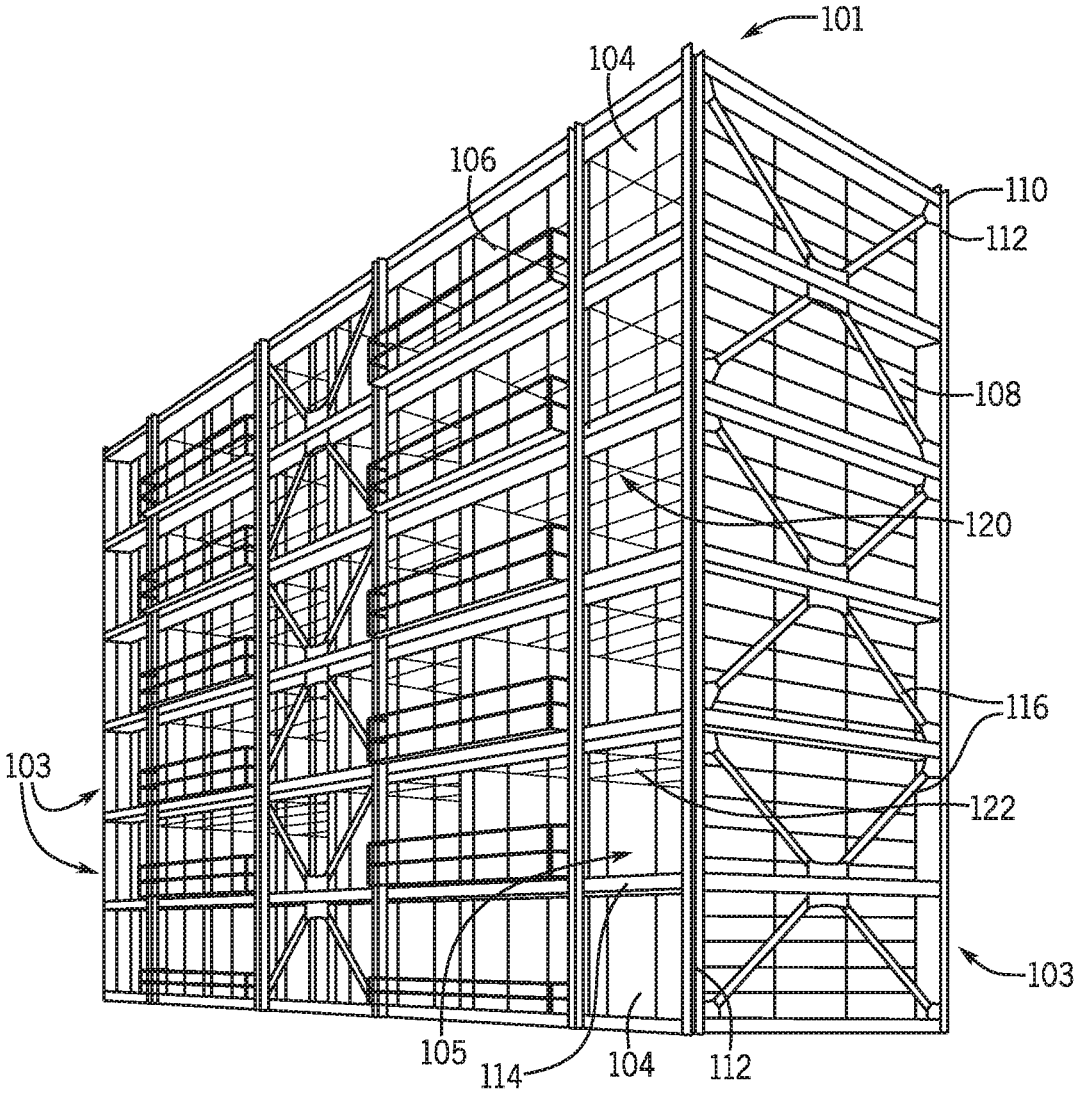
FIG. 1 is an illustration of an example multi-story building.

all arranged in accordance with at least some examples of the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatus generally related to pre-assembled panels (e.g., pre-assembled floor-ceiling panels, pre-assembled walls) for use in a building and to building systems which include a diaphragm provided by one or more pre-assembled floor-ceiling panels and in which vertically extending pre-assembled walls may be coupled to the diaphragm to define the envelope of the building and/or divide the interior of the building into units (e.g., a dwelling or commercial unit or a room within such dwelling or commercial unit). A building assemblies according to the present disclosure may be a single building components, such as a pre-assembled panel, or an assembly of a plurality of components (e.g., beams and/or panels), not necessarily a fully assembled building.

In some examples, the pre-assembled panels may be assembled off-site in a shop and then transported to the building site for assembly into the building system. At the building site, the pre-assembled panels may be attached directly or indirectly to a building frame. The building frame may be an external frame. The term external frame, also referred to as external structural frame, will be understood to refer to a structural frame of a building which is arranged generally externally to the envelope of the building. This is, in contrast to other types of structural frames that include vertical and horizontal load bearing members located within the perimeter defined by the building envelope, as is typical in timber construction for example, the external frame is arranged outside the perimeter of the building envelope. As is generally known in the field of structural engineering, the structural frame is the load-resisting or loadbearing system of a building which transfers loads (e.g., vertical and lateral loads) into the foundation of the building trough interconnected structural components (e.g., load bearing members, such as beams, columns, loadbearing walk, etc.). The design and construction of a building with an external frame may have advantages over internally framed buildings but may also bring new challenges, some of which may be addressed by examples of the present disclosure.

For example, building regulations in countries around the world impose requirements for the design and construction of buildings to ensure the safety to occupants of the building. In many countries, these regulations (also referred to as building codes), require that a building be designed and constructed such that, for example in case of a fire, the stability of the building (e.g., its load bearing capacity) is maintained for a reasonable period of time (e.g., a time sufficient to allow the occupants to egress the building). Therefore, typically, building codes in many countries impose fire proofing requirements to any load bearing structure (e.g., vertical and horizontal load bearing members). Modern steel framed buildings are sometimes constructed with external structural frames, i.e., where the structural frame on the outside of the façade, that is external to the building's envelope. In the event of a fire, an external structural frame may thus be heated only by flames emanating from windows or other openings in the building façade and the fire exposure to the external steelwork may thus be much less severe as compared to what the steel inside the building experiences. In some such cases, and depending on the design of the building and frame, the external frame, or at least some components thereof, may not need to be fire-proofed as is generally required any steel frame members located within the interior to the building, which may reduce material (e.g., spray on fire resistive materials and/or intumescent paint) and/or construction costs.

The diaphragm of a building system in accordance with some embodiments of the present disclosure may be provided by one or more, and typically a plurality, of pre-assembled floor-ceiling panels. The use of pre-assembled floor-ceiling panels may obviate the need for using concrete slab construction as is typically done, e.g., in mid- and high-rise construction. That is, in examples of the present disclosure, the diaphragm, which may provide a floor system of a building such as building 101 discussed further below, may be constructed from pre-assembled floor panels without the use of a concrete slab, which may further improve the cost/efficiency of erecting the building by removing a step in a conventional building construction process (e.g., the concrete slab pouring/curing step). Additionally, the pre-assembled floor-ceiling panels may be arranged in a manner that reduces the overall use of structural steel needed to support and transfer loads from the diaphragm to the external frame and consequently may reduce cost for erecting and generally conforming the building to code (e.g., fireproofing structural steel). Pre-assembled panels for use in a diaphragm according to the present disclosure may define part of or the whole of a floor and part of or the whole of a ceiling in the building, such as part of or the whole of a floor and ceiling of a building unit. Thus, in some examples, such pre-assembled panel may interchangeably be referred to herein as a floor and ceiling panel, a floor-ceiling panel, or a floor ceiling sandwich (ITS) panel. The floor may be a portion of a story of the building above the panel, and the ceiling may be a portion of a story of the building below the panel.

The pre-assembled panel(s) used in a diaphragm according to some embodiments may include a floor-panel frame, a floor panel, and a ceiling panel. The floor and ceiling panels may be spaced from one another by the floor-panel frame. The floor-panel frame may separate the floor panel from the ceiling panel. The floor-panel frame may include a plurality of joists positioned between the floor panel and the ceiling panel. The floor-panel frame may define one or more joist cavities between adjacent joists. In some examples, the one or more joist cavities may accommodate plumbing, cabling, wiring, or other conduits or other elements that may support dwelling or commercial units in the buildings. An insulative material may be located in the one or more joist cavities. In some examples, cross members may be provided in or operatively arranged relative to the one or more joist cavities, for example for increasing the lateral stability of the panel. In some examples, the cross members may be implemented in the form of straps, such as metal straps, connected between opposite corners of a joist cavity. Sound dampener material (also referred to as sound insulative material) may be positioned between the floor-panel frame, the floor panel, and the ceiling panel to reduce sound transmission through the floor and ceiling panel.

The floor panel may be attached to an upper side of the frame, also referred to as floor side of the frame. The floor panel may support a floor material (e.g., a floor finish such as tile, hardwood, manufactured wood, laminate or others) of an upper story. The floor panel may be formed of one or more layers of non-combustible material and may include a radiant heating element. The ceiling panel may be formed of one or more layers of non-combustible materials and may be attached to a lower side of the frame, also referred to as ceiling side of the frame. The ceiling panel may support a ceiling material (e.g., a ceiling finish such as ceiling tiles or other type of finish as may be desired) of a lower story. In some embodiments, the floor-ceiling panels may be implemented in accordance with any of the examples described in co-pending international patent application PCT/US17/21168, titled "Floor and Ceiling Panel for Slab-free Floor System of a Building," which application is incorporated is incorporated herein by reference in its entirety for any purpose.

A pre-assembled wall used in a building assembly according to some embodiments herein may include an interior or demising wall or an exterior or envelope wall. The pre-assembled wall may be pre-assembled (in a factory) to include some or all of the conduits, insulation, and other components typically provided between the wall finish materials in conventional construction, such as any components as may be desired or need to support use of the building unit. In some embodiments, the pre-assembled wall may be pre-assembled to include one or more of the plumbing conduits (e.g., water and sewer pipes) needed to supply plumbing services to the unit. Such pre-assembled walls may be interchangeably referred to as utility walls. In some embodiments, a pre-assembled wall according to some embodiments herein may include a wall-panel frame including a plurality of studs, wall-boards disposed on opposite sides of the studs and defining a wall cavity, and finish materials attached to each side of the wall. For an interior wall, interior finish panels may be pre-assembled to the wall, one or more of which may be removable temporarily for installation of the wall. For exterior walls, one side of the wall may be pre-assembled to include interior finish panels and the other side of the wall may be pre-assembled to include exterior finish materials (also referred to as cladding).

In some embodiments, the material composition of the floor-panel and/or the wall-panel frame may be predominantly metal, for example and without limitation aluminum, steel, or alloys thereof. In some embodiments it may be predominately aluminum. In still other embodiments, floor-ceiling panel components (e.g., floor panels, ceiling panels, and/or floor finish materials) and wall components (e.g., wall-boards and/or or interior and exterior finish layers) may be made from a variety of building suitable materials comprising metals, to wood and wood polymer composites (WPC), wood based products (lignin), other organic building materials (bamboo) to organic polymers (plastics), to hybrid materials, or earthen materials such as ceramics. In some embodiments cement or other pourable or moldable building materials may also be used. In other embodiments, any combination of suitable building material may be combined by using one building material for some elements of the panel and other building materials for other elements of the panel. Selection of any material may be made from a reference of material options (such as those provided for in the International Building Code), or selected based on the knowledge of those of ordinary skill in the art when determining load bearing requirements for the structures to be built. Larger and/or taller structures may have greater physical strength requirements than smaller and/or shorter buildings. Adjustments in building materials to accommodate size of structure, load and environmental stresses can determine optimal economical choices of building materials used for all components in the system described herein. Availability of various building materials in different parts of the world may also affect selection of materials for building the panel described herein. Adoption of the International Building Code or similar code may also affect choice of materials.

Any reference herein to "metal" includes any construction grade metals or metal alloys as may be suitable for fabrication and/or construction of the system and components described herein. Any reference to "wood" includes wood, wood laminated products, wood pressed products, wood polymer composites (WPCs), bamboo or bamboo related products, lignin products and any plant derived product, whether chemically treated, refined, processed or simply harvested from a plant. Any reference herein to "concrete" includes any construction grade curable composite that includes cement, water, and a granular aggregate. Granular aggregates may include sand, gravel, polymers, ash and/or other minerals.

In referring now to the drawings, repeating units of the same kind or generally fungible kind, are designated by the part number and a letter (e.g. 214*n*), where the letters "a", "b" and so on refer to a discrete number of the repeating items. General reference to the part number followed by the letter "n" indicates there is no predetermined or established limit to the number of items intended. The parts are listed as "a-n" referring to starting at "a" and ending at any desired number "n".

FIG. 1 illustrates a building system in accordance with at least some embodiments of the present disclosure. FIG. 1 shows building 101, which may include an external structural frame 110 and a diaphragm 120 in accordance with the present disclosure. FIG. 1 shows stories 103 and units 105 of the building 101, columns 112, beams 114, and cross braces 116 of the external structural frame 110, as well as floor-ceiling panels 122, window panels 104, interior (or demising) walls 106, and end walls 108. The various components and arrangement thereof shown in FIG. 1 is merely illustrative, and other variations, including eliminating components, combining components, and substituting components, or rearranging components are all contemplated.

The building 101 may include two or more stories or levels 103. The envelope of the building 101 may be defined by exterior walls and windows, e.g., by end walls 108, window panels 104, which may include floor to ceiling window panels defining a window wall, and/or utility walls (not shown in this view). These walls may be referred to as the building's exterior or envelope walls. The interior of the building 101 may be divided into one or more dwelling or commercial units 105 and/or one or more rooms of a unit using interior walls, also referred to as demising walls 106. In embodiments of the present disclosure, the various walls (e.g., demising walls 106, end walls 108, and window walls) of the building 101 may not be load bearing walls. Rather, loads may be transferred to and carried by the external structural frame 110. Loads (e.g., lateral loads from wind and/or earthquakes) may be transferred to the external structural frame 110 via the diaphragm 120, as will be further described.

The building 101 may be classified as a low-rise, mid-rise, or high-rise construction depending on the number of stories (each city or zoning authority may define building heights in any fashion they deem proper). The building 101 may include, as part of the diaphragm 120, one or more floor-ceiling panels 122. A floor-ceiling panel as described herein may be suitable for use in a building of any number of stories (levels), including a mid-rise building and a high-rise building. In some embodiments, the building may be a residential multi-dwelling building having six, seven, eight or more stories, and in some example twenty five, thirty five, fourth five, or more stories (e.g., as in high-rise or skyscraper construction).

As shown and described, the building 101 may include an external structural frame 110. The external frame 110 may serve as a structural exoskeleton of the building 101. The external frame 110 may include multiple columns 112 (also referred to as frame columns), beams 114 (also referred to as frame beams), and/or cross braces 116. The columns 112 are oriented vertically, the beams 114 are oriented horizontally, and the cross braces 116 may be oriented horizontally or obliquely to the columns 112. For example cross braces may be horizontally oriented (e.g., as the frame beams 114) connecting adjacent columns, or they may be obliquely oriented to the columns and/or beams, e.g., as the cross-braces 116 illustrated in the example in FIG. 1. The beams 114 may extend between and be attached to adjacent columns 112 to connect the adjacent columns 112 to one another. The cross braces 116 may extend between and be attached to one or more of the beams 114, columns 112, or a combination thereof, to provide additional stiffness to the external frame 110. As described, in various embodiments, the external frame 110 may provide the structural support for the building 102, while some or all of the walls of the building may generally be non-loadbearing walls. That is, in embodiments herein, the frame columns, frame beams, and cross braces may be arranged to provide most or substantially all the structural support or loadbearing capability for building 101 and the diaphragm 120 may be designed to transfer loads to the structural frame, whereby the load is then carried into the foundation of the building.

The building 101 may include multiple units or modules 105 disposed internally of the external frame 110. The units 105 may be commercial, residential (such as dwelling units), or a combination thereof (e.g., live-work units). The units may be standardized and repetitive, or unique and individualized. Mixed units of standard size and shape may be combined with unique units in the same floor, or in independent arrangement on separate floors. In some embodiments, a unit may encompass more than one floor. The units 105 may be assembled at the building site using multiple pre-assembled or pre-assembled components (e.g., pre-assembled floor-ceiling panels 122, prefabricated walls, etc.). The pre-assembled components may be assembled independent of one another remotely from the building site and transported to the building site for installation. The pre-assembled components may include, as delivered to the building site, most or all of the components to support the commercial or residential use of the units, e.g., electrical and/or plumbing conduits, heating and air conditioning ducting, etc. Thus, installation of sub-systems in the field may be reduced, thus again reducing the overall cost and construction timeline. The pre-assembled components may be attached to the external frame 110, to adjacent components, or both at the building site to erect the building 101 and form the individual units 105. In some embodiments, the building 101 may include internal support (e.g., loadbearing) structures. For example, the diaphragm 120 may include one or more support beams (see e.g., transverse beams 230 in FIGS. 2A and 2B), which may also be referred to herein as diaphragm beams. The diaphragm beams may support the one or more floor-ceiling panels 122 that form part of the diaphragm 120. The diaphragm beams may be attached to the external structural frame 110 (e.g., to a frame column and/or a frame beam) to transmit load from the diaphragm to the structural frame.

Pre-assembled components according to the present disclosure may include one or more pre-assembled or pre-assembled floor-ceiling panels 122 and one or more pre-assembled or pre-assembled walls (e.g., demising wall 106, end wall 108). The floor-ceiling panels 122 are oriented substantially horizontally to define the floor of an upper unit and the ceiling of a lower unit. Individual floor-ceiling panels 122 may be arranged horizontally and adjacent to one another along their longitudinal direction. The longitudinal direction may be the direction of longer length of a rectangular panel. The longitudinal direction may be the direction along which the joists run. The transverse direction may be direction of shorter length of a rectangular panel, i.e., the direction perpendicular to the longitudinal direction. The longitudinal and transverse directions refer to the planform shape of the panel, each panel also having a thickness direction which is perpendicular to the longitudinal and transverse directions. In some examples, the panels may be generally square in shape in which case the longitudinal direction may be the direction along which the joists run. Individual floor-ceiling panels 122 may be attached to one another, one or more columns, one or more beams, or any combination thereof. The individual floor-ceiling panels 122 may be coupled to and supported by diaphragm beams, which in turn may be coupled to the external frame, such as via a coupling between a respective diaphragm beam and one or more beams 112 and/or columns 114 of the external frame 110 to transfer loads from the diaphragm 120 to the external frame 110. The walls (e.g., demising walls 106 and end walls 108) may be oriented substantially vertically to define the envelope of the building and/or partition each story into multiple units, a single unit into multiple rooms, or combinations thereof. The walls may be attached to the floor-ceiling panels 112 with fasteners and then caulked, sealed, or both. In some embodiments, some of the walls of building 101 may additionally or alternatively be attached to the diaphragm beams that support the floor-ceiling panels 112.

Figure 2A:
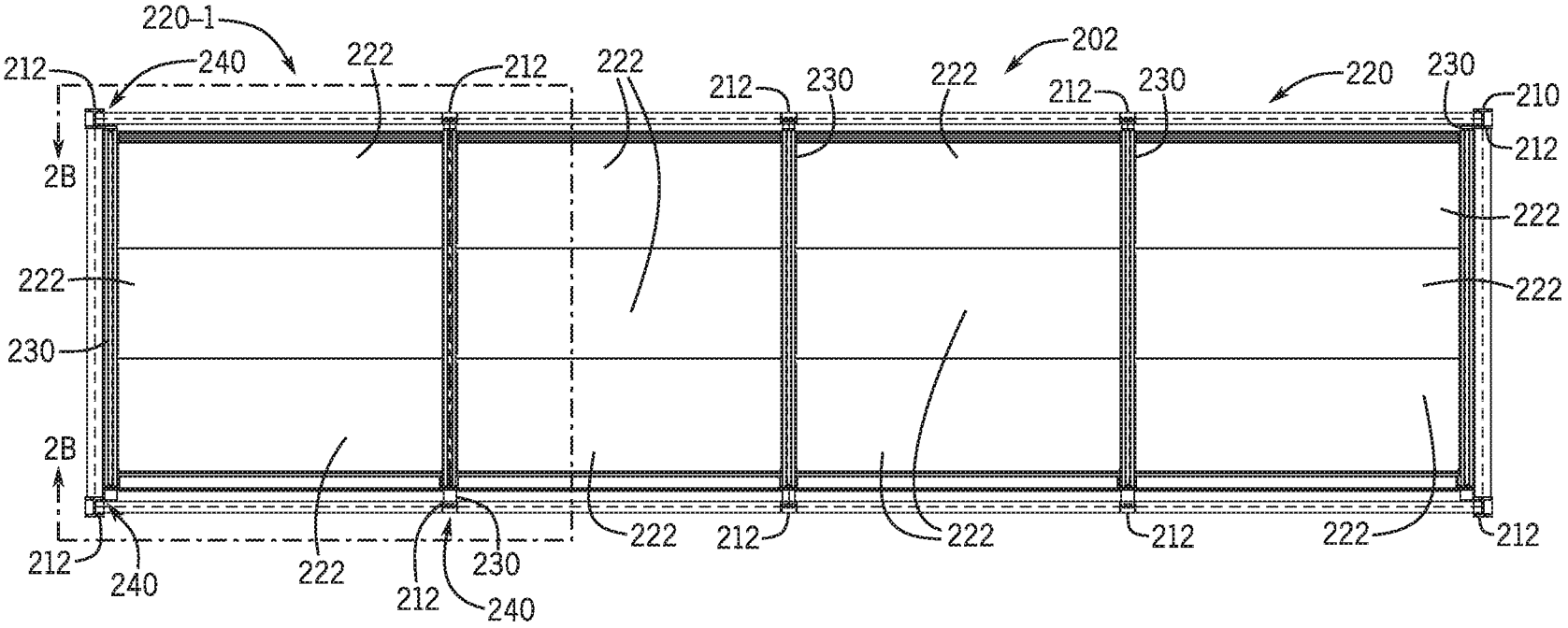
FIG. 2A is an illustration of a floor system of a building.
Figure 2B:
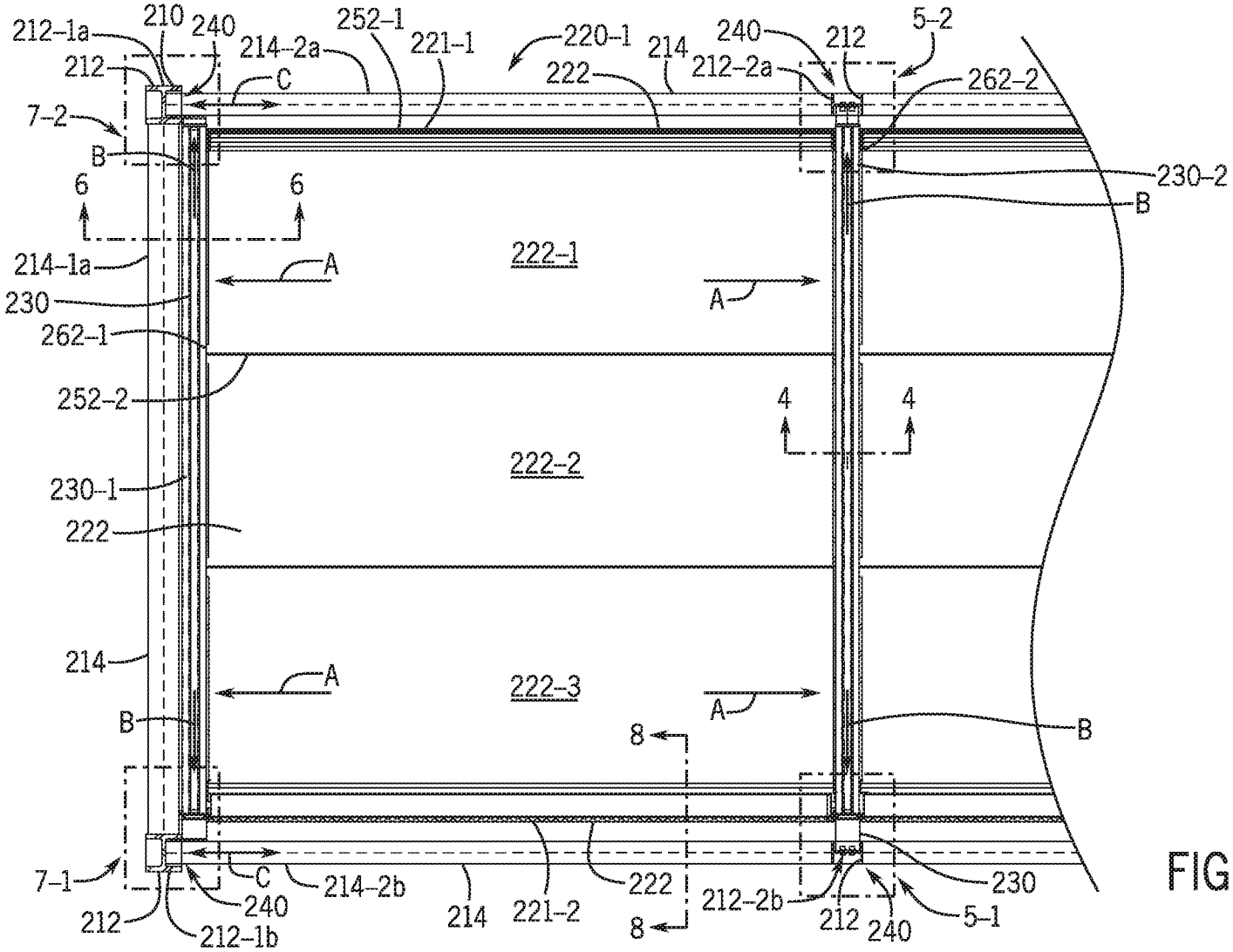
FIG. 2B is an illustration of a portion of the floor system in FIG. 2A.

FIGS. 2A and 2B illustrate an example diaphragm 220 arranged in accordance with the present disclosure. The diaphragm 220 may form part of the floor system 202 of a building, such as building 101 in FIG. 1. The diaphragm 220 may be used to implement the diaphragm 120 of the building 101 in FIG. 1. FIGS. 2A and 2B show, in plan view, external structural frame 210, a plurality of columns 212 including columns 212-1, 212-2, 212-3, and 212-4, a plurality of beams 214 including beams 214-1, 214-2, 214-3, diaphragm 220, a plurality of floor panels 222 including floor panels 222-1, 222-2 and 222-3 diaphragm beams 230, and a plurality of coupling assemblies 240. The various components and arrangement thereof shown in FIGS. 2A and 2B are merely illustrative, and other variations, including eliminating components, combining components, and substituting components, or rearranging components are all contemplated.

The floor system 202 may be part of a multi-story building (e.g., building 101 in FIG. 1) which includes an external structural frame 210. As described, the external frame 210 may serve as a structural exoskeleton of the building. The external frame 210 may include multiple columns 212 extending vertically from a foundation of the building. The columns 212 may be braced by beams 214, also referred to as frame beams to distinguish them from the diaphragm beams 230 employed in constructing the diaphragm as will be described, and/or oblique cross-braces (not shown in this view). The beams 214 may extend horizontally, connecting adjacent columns. As is generally known in building construction, buildings may include a variety of support systems arranged to withstand different forces applied to the building. For example, vertical load systems cope with forces placed upon a structure by gravity while lateral load systems manage forces placed upon the structure by other forces such as high winds, floods, and seismic activity. Vertical load systems may include loadbearing walls and/or columns. Lateral load systems may include cross-braces, shear walls, and moment-resisting frames. Diaphragms are part of the horizontal structure of the building. The horizontal structure may include the floors of a building and its roof. The diaphragms may translate both vertical and lateral loads to the vertical and lateral load systems of the building. For example, the building's diaphragms may be coupled directly to the lateral load system to translate lateral loads. If loads are not properly translated from the diaphragm, the diaphragm may fail, and the structural integrity of the building may be compromised. In accordance with embodiments of the present disclosure, a diaphragm of a building constructed, at least in part, using pre-assembled components is arranged to effectively transfer loads into the lateral load system of the building while reducing the amount of fireproofing materials (e.g., intumescent paint) that may otherwise be required to fire-proof the building to code.

In the case of an external frame, the columns 212 (e.g., columns 212-1, 212-2, 212-3, and 212-4) may be arranged around the perimeter of the building. The beams 114 may connect adjacent columns and the columns and beams 212, 214, respectively, of the structural frame 210 may define, when viewed in plan as shown in FIGS. 2A and 2B, a generally rectangular space therebetween. A diaphragm 220 may be arranged within the rectangular space and coupled to the external frame. For example, the diaphragm 220 may be attached (e.g., mechanically fastened with bolts or welded) to any combination of the beams and/or columns of the frame 210 to transfer loads thereto.

In the illustrated example in FIG. 2A, the frame 210 includes four end columns (e.g., 212-1*a*, 212-1*b*) located at each of the four corners of the building, and pairs of intermediate columns (e.g., 212-2*a* and 212-2*b*), in this case three pairs of intermediate columns arranged opposite one another between the end columns. A beam extends between and peripherally joins each two adjacent columns to form, at least in part, the external frame 210 of the example in FIG. 2A. For example, beam 214-1*a* is arranged at one end of the building and joins the pair of adjacent end columns 212-1*a* 212-1*b* and similarly another beam is arranged at the opposite end joining the other pair of adjacent end columns. Perpendicularly arranged beams (e.g., beam 214-2*a*, 214-2*b*) extend between and join each end column to an intermediate column or two adjacent intermediate columns to one another. Thus, in this illustrated example, the floor system may include four sections, each of which may be associated with a single unit or in some cases a single unit may span multiple such sections. One of the four sections of this example is shown in an enlarged view in FIG. 2B and the diaphragm portion (e.g., diaphragm 220-1) associated therewith is described in more detail below with further reference to FIG. 2B. In other examples, different number or combinations of columns and beams may be used for the external structural frame 210. For example, its simplest arrangement, such as for a smaller footprint building, the external frame 210 may include only the four end columns without any intermediate columns, and the diaphragm may be formed using a single or a plurality of floor panels each connected at its opposite ends to a single pair of diaphragm beams that are in turn connected to the external frame, e.g., as in the partial view shown in FIG. 2B. Regardless of the size, number and/or specific arrangement of components, the principles of the diaphragm and the load path described herein may be preserved.

Referring now further to FIG. 2B, the diaphragm 220-1 may be constructed using one or more pre-assembled floor-ceiling panels 222. The individual pre-assembled floor-ceiling panels 222 may be generally rectangular in shape and have a pair of opposite longitudinal edges 252-1 and 252-2 extending along the longitudinal direction 250, and a pair of opposite transverse edges 262-1 and 262-2 extending along the transverse direction 260 of the panel 222. As will be further described (e.g., with reference to FIG. 3), each panel 222 may be pre-assembled (prior to delivery to the building site) to include a plurality of joist in a spaced arrangement between the opposite longitudinal edges. The joists may extend along the longitudinal direction (i.e., span the length of the panel). To construct the diaphragm, in examples where multiple floor-ceiling panels 222 are used, the panels 222 may be arranged side by side, e.g., with longitudinal edges adjacent to one another, and joined along their longitudinal edges, for example using first mounting components (e.g., one or more brackets which may be fastened or welded to one another).

To assemble the panels 222 into the diaphragm 220, the panels 222 may be supported by diaphragm beams 230 along their transverse edges. In some embodiments, the panels 222 may be supported only along their transverse edges. In some examples, each panel may include one or more second mounting components (e.g., one or more angle or L-shaped brackets) which may be rested against and joined (e.g., mechanically fastened, welded or otherwise joined) to a diaphragm beam 230. For example, the lateral edges 262-1 of the panels 222 may be joined to diaphragm beam 230-1 and the opposite lateral edges 262-2 of the panels 222 may be joined to another diaphragm beam 230-2. The diaphragm beam 230-1 may be arranged near and extend between end columns 212-1*a* and 212-1*b*. The diaphragm beam 230-2 may be arranged to extend between columns 212-2*a* and 212-2*b*. The diaphragm beams 230 may be joined to the external frame and may thereby transfer load from the diaphragm to the frame. For example, opposite ends of the diaphragm beam 230-1 may be joined to each of the pair of frame beams 212-2*a* and 214-22*b*. In other embodiments, the diaphragm beam 230-1 may be joined to directly to the columns or another component of the external frame. In some embodiments, the diaphragm beam 230-1 may be adjacent to (e.g., parallel to) a frame beam 214-1*a* that connects the end columns 212-1*a* and 212-1*b*. While the diaphragm beam 230-1 may be fire-rated, the frame beam 214-1*a* may or may not be fire-rated. The term fire-rated in the context herein is generally used to imply that the component is configured to meet the relevant fire code. In some examples, both of the adjacent beams (e.g., the diaphragm beam 230-1 and the frame beam 214-1) may be configured such that they meet the fire code. In some embodiments, the diaphragm beams (e.g., beams 230-1, 230-2) may be filled with a mineral-based material such as concrete (see e.g., FIG. 4), which may enable the diaphragm beams to meet fire code. The term filled, in the context herein, implies that at least a portion (e.g., 40%, 50%, 65%, 80% or more) of the interior of the beam is filled with the material, not necessarily completely filled. In other embodiments, the beams may be fire-rated using different materials, for example using conventional techniques such as via intumescent coatings, sprayed on mineral-based materials, insulative blankets, or others in addition to or in combination with filling the beam with a mineral-based material. It will be understood that in the context of the present disclosure, the beam being "filled" with a material.

In some embodiments, the diaphragm beam 230-2 supporting the opposite transverse edges of the floor-ceiling panels may be joined directly to the columns 212-2*a* and 212-22*b* (e.g., as shown in FIG. 2B), or it may be joined to a beam or other component of the structural frame.

The diaphragm may not be joined to a load bearing member along its longitudinal edges 221-1 and 221-2. Rather all loads from the diaphragm may be transferred to the external frame via the diaphragm beams 230, e.g., via the coupling assemblies 240 between the diaphragm beams 230 and the external frame 210, for example by following the load path diagrammatically illustrated by arrows A-C. As shown, load may be transferred along the diaphragm towards the transverse edges 262-1, 262-2 of the panels 222 as shown by arrows A. The load may be transferred to the diaphragm beams 230 (e.g., by the joints between the floor-ceiling panels and the diaphragm beams) and may then be transmitted along the diaphragm beams 230 toward the external frame 210 as shown by arrows B. The load may be transmitted from the diaphragm 220 to the external frame 210 via the coupling assemblies 240 between the diaphragm beams 230 and the external frame 210. For example, load may be transmitted to the beams (e.g., beams 214-2*a* and 214-2*b*) and then the columns (e.g., columns 212-1*a* and 212-1*b*), as shown by arrows C, or directly to a column (e.g., columns 212-2*a*, 212-2*b*) of the external frame 210, which then transfer the load to the foundation.

As illustrated, the panels 222 that form part of the diaphragm are not directly joined to the structural frame along at least one longitudinal edge (also referred to as unsupported longitudinal edge) and thus no load is transferred to the structural frame trough the interface of any other building components arranged along the unsupported longitudinal edge. Rather structural loads are transmitted from the panels to the diaphragm beams (e.g., via the internal structure of each panel such as the joists) and then the load is transmitted to the external frame via the coupling assemblies 240. In this regard, the panels 222 may be said to be unsupported along at least one of their longitudinal edges. In some embodiments, non-loadbearing walls may be joined to the floor-ceiling planes 222 along the longitudinal unsupported edges, such as a window wall or a utility wall. In some embodiments, one or more of the non-load bearing walls (e.g., end wall 108, window walls, utility walls) may be continuous walls that span the full distance between two columns of the external frame. For example, in the illustrated embodiment in FIG. 2B, the diaphragm 220-1 includes a first floor-ceiling panel 222-1 which has a first longitudinal edge 252-1 configured to support a window wall of the building and a second longitudinal edge 252-2 coupled to an adjacent middle panel 222-2. The first longitudinal edge 252-1 of the panel 222-1 also defines a first unsupported diaphragm edge 221-1 of diaphragm 220-1. The middle panel 222-2 is coupled on opposite sides (e.g., along both longitudinal edges) to other floor-ceiling panels. A third floor-ceiling panel 222-3, which defines the diaphragm's second unsupported diaphragm edge 221-2, is configured to be coupled to another non-loadbearing (e.g., a utility wall). In accordance with the examples herein, the amount of structural steel and thus fire-proofing of structural steel may be reduced by eliminating structural steel along the longitudinal edges of the panels.

Figure 3:
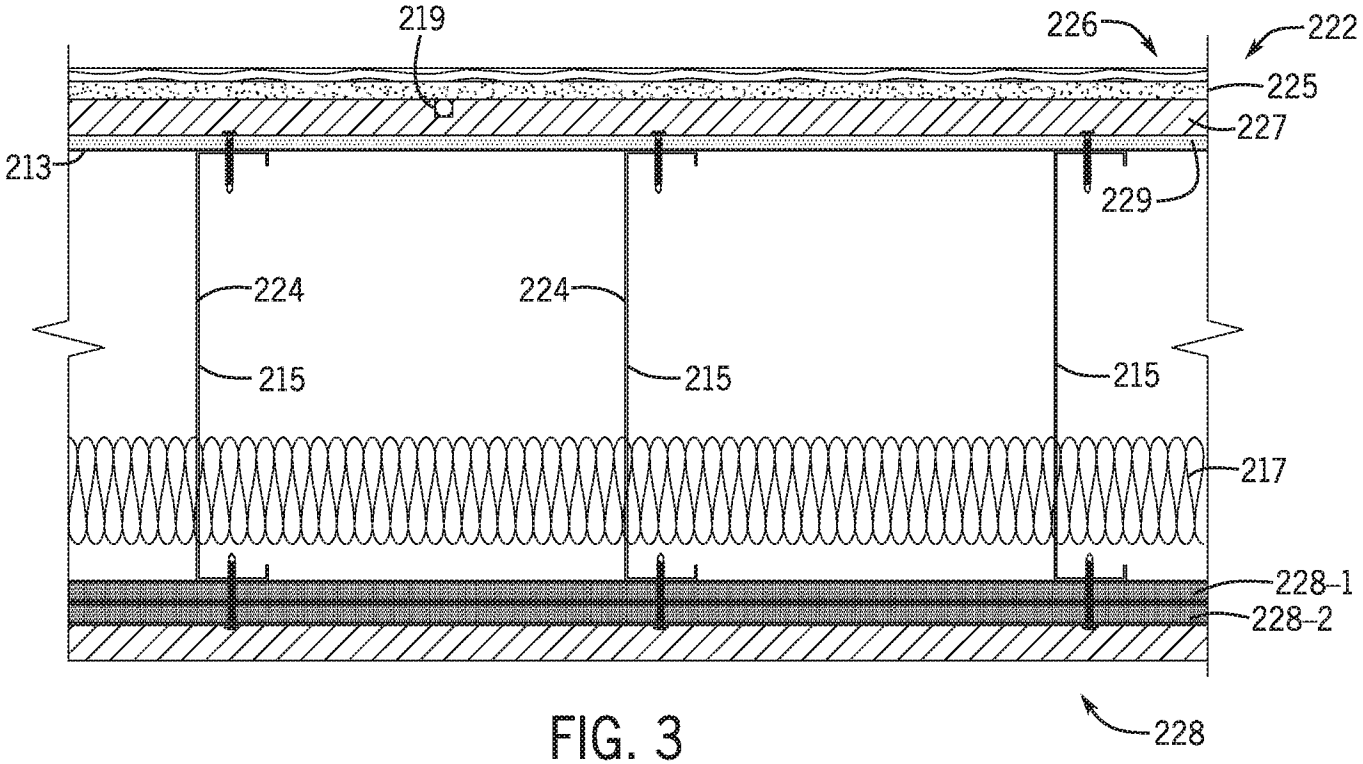
FIG. 3 is a partial cross-sectional view of one of the pre-assembled floor-ceiling panels in FIG. 2A taken along line 3-3.

FIG. 3 shows a partial cross section of a pre-assembled floor panel 222 in accordance with some embodiments of the present disclosure. The various components and arrangement thereof shown in FIG. 3 are merely illustrative, and other variations, including eliminating components, combining components, and substituting components, or rearranging components are all contemplated. The floor-ceiling panel 222 may have a generally box shaped construction, which may be designed to distribute and carry loads towards the transverse edges of the panel. The panel 222 may be pre-assembled to include a floor-panel frame 224, which includes a plurality of joists 215 in a spaced laterally and extending along the longitudinal direction of each panel. An upper or floor panel 226 and a lower or ceiling panel 228, respectively, may be joined to opposite sides of the frame. Insulation 217 may be provided within the cavity defined between the upper and lower panels 226, 228, respectively. The pre-assembled floor-ceiling panels 222 may be configured to carry diaphragm loads to the structural frame without the use of a concrete slab, as is typically done in conventional construction.

The individual layers of the floor panel 226 and the ceiling panel 228 may be formed using discrete (e.g., separable) pre-manufactured construction elements (e.g., boards of non-combustible materials, such as cement board, magnesium oxide (MgO) board, fiber-cement board, gypsum board, fiberglass-clad cement or gypsum board, metal-clad cement or MgO board, and other suitable mineral-based materials), which may be joined to the floor-panel frame 224 off-site (e.g., in a factory or other location remote) prior to delivery of the floor-ceiling panels 222 to the building site, thus reducing on-site construction time/costs. The floor panel 226 may include at least one layer 225 made substantially from non-combustible material (e.g., cement board, magnesium oxide (MgO) board, etc.) and at least one metal diaphragm layer 213 (e.g., a sheet of steel such as a 22 gage steel sheet or another). The metal diaphragm layer 229 may be attached to (e.g., bonded or mechanically fastened) the non-combustible material and/or to the floor-panel frame 224. In some embodiments, the metal diaphragm layer may be simply sandwiched between layers of the floor panel 226 and/or the floor-panel frame 224 (e.g., between a layer of non-combustible material and the frame or between two layers of non-combustible material) without being otherwise attached thereto. In some embodiments, the floor panel 226 may include a radiant heating element 219, which may be provided in a layer (e.g., foam or other type of insulative layer 227) of the floor panel 226. The ceiling panel 228 may include at least one layer (e.g., layers 228-1, 228-2) made substantially from non-combustible material (e.g., cement board, magnesium oxide (MgO) board, fiber-cement board, gypsum board, fiberglass-clad cement or gypsum board, metal-clad cement or MgO board, and other suitable mineral-based materials).

In some embodiments, the panel frame 224 (e.g., joists 215) may be formed of metal, such as aluminum or steel. In some embodiments, the panel frame 224 may be formed of a non-metallic material, such as wood, plastic, or composite materials such as fiber reinforced composites. In the illustrated example, the joists 215 are implemented using metal C-channels, e.g., of lightweight steel as manufactured by Steelform Building Products Inc. (marketed under the name Mega Joist). A variety of other types of joists, for example and without limitation I-shaped, or closed, box shaped joists may be used in other embodiments. The insulation 217 provided in the panel 222 may include thermal and/or sound insulation. For example, sound dampening materials (e.g., sound strips) may be provided between the individual layers of the floor panel 226 and the ceiling panel 228 and/or between these panels and the frame (e.g., between the panels and the joist). The floor-ceiling panels 222 may define a generally enclosed space by the floor-panel frame 224 and the floor and ceiling panels 226, 228, respectively. Mounting components (e.g., angles, angle clips, L-shaped or C-shaped brackets, or brackets of other types or geometries) may be joined to the floor-panel frame 224 along the longitudinal and transverse edges of the panel 222 for joining each panel to an adjacent panel and/or to a diaphragm beam.

As described, a building assembly according to some embodiments of the present disclosure may include at least one diaphragm beam (e.g., diaphragm beam 230-1, 230-2) having opposite ends connected to an external structural frame (e.g., frame 210) of a building. The building assembly may further include at least one pre-assembled floor-ceiling panel (e.g., panel 222) adjacent to a vertical side of and coupled to the diaphragm beam, and at least one pre-assembled wall (e.g., a demising wall 106, an end wall 108, or a utility wall) which is adjacent to a horizontal side of and coupled to the diaphragm beam. In some embodiments, building assemblies according to the present disclosure may be used to implement one or more interfaces of or joints joining horizontally adjacent floor-ceiling panels and one or more interior or demising walls to a diaphragm beam, e.g., as shown and described with reference to FIGS. 4-5. In further embodiments, building assemblies according to the present disclosure may be used to implement one or more interfaces of or joints joining vertically adjacent exterior walls and at least one floor-ceiling panel to a diaphragm beam, e.g., as shown and described with reference to FIGS. 6-7.

Figure 4:
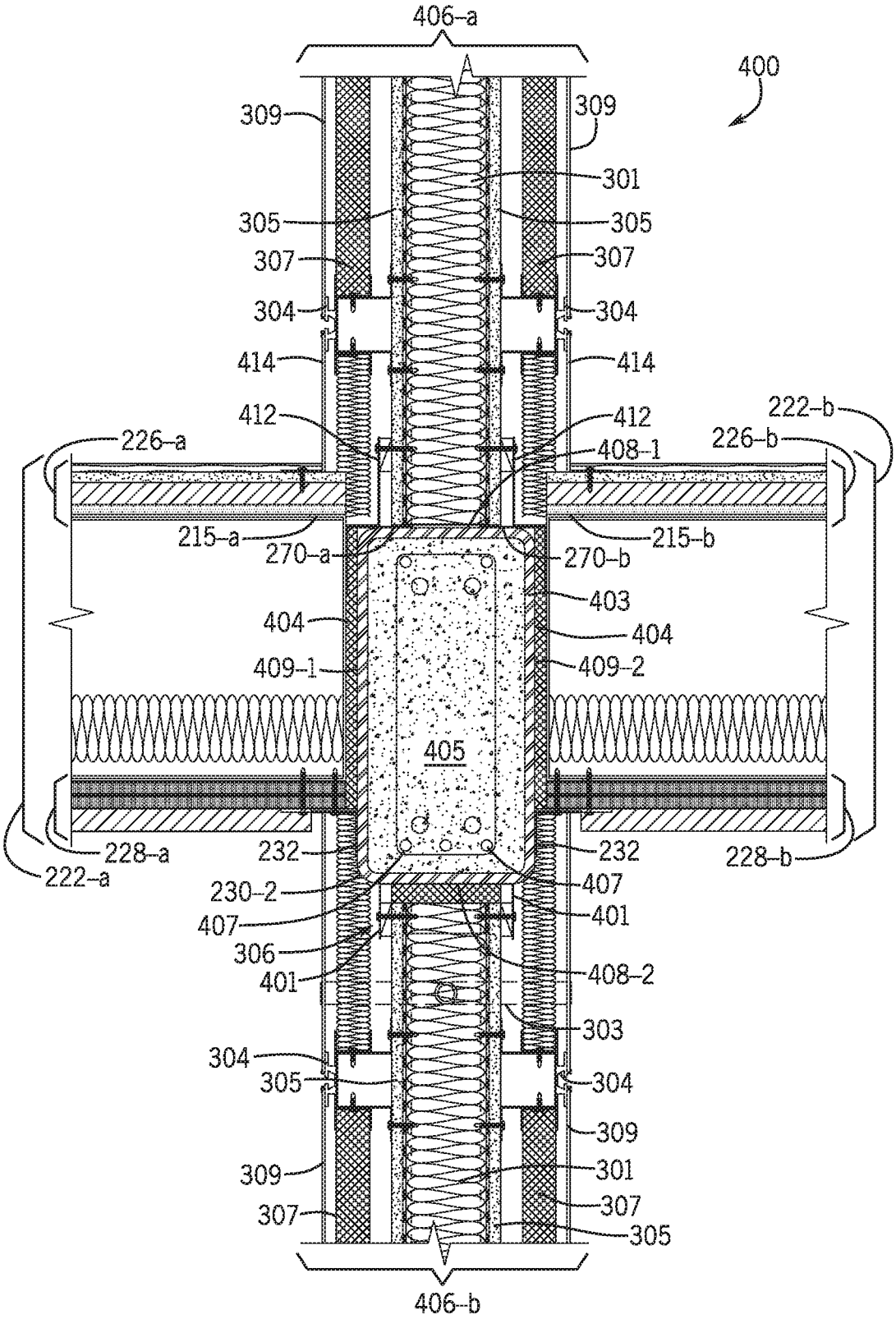
FIG. 4 is a partial cross-sectional view of a building assembly showing an interface between horizontally adjacent pre-assembled floor-ceiling panels and vertically adjacent pre-assembled walls.

FIG. 4 illustrates a cross-sectional view of a portion of a building assembly according to some embodiments of the present disclosure. FIG. 4 shows a building assembly 400 including floor-ceiling panels 222-*a* and 222-*b*, demising walls 406-*a* and 406-*b*, and diaphragm beam 230-3. The components of building assembly 400 and arrangement thereof shown in FIG. 4 are merely illustrative, and other variations, including eliminating components, combining components, and substituting components, or rearranging components are all contemplated. For example, in some embodiments, the building assembly may include a demising wall on only one side (e.g., the ceiling side or the floor side) of the floor-ceiling panels.

The building assembly 400 may include a diaphragm beam 230-2, which in some embodiments may be filled with a mineral-based material 405, e.g., concrete, and/or other type of non-combustible or fire-resistant material. The diaphragm beam 230-2 may be implemented using an elongate, closed cross-section member 403, such as a steel, hollow structural section (HSS) beam, and which encloses the mineral-based material 405 or other type of non-combustible or fire-resistant material. Filling the interior of the diaphragm beams with a mineral-based or other type of non-combustible or fire-resistant material may enable the beam meet fire code, and thus obviate the need to use other types of fire resistant treatments (e.g., intumescent paint, spray on insulation, etc.), which may be more costly or more time consuming to install. The filling of the diaphragm beam with a mineral-based material 405 may additionally provide improved load-carrying capability which may enable the construction of a diaphragm that is not supported by beams along at least some edges (e.g., the longitudinal edges) of the diaphragm. In some embodiments, the diaphragm beam 230-2 may include an at least one reinforcing member 407 embedded in the mineral-based material 405. For example, the reinforcing member(s) may include one or more elongate metal rods (e.g., rebar) which extend along at least a portion of, and in some cases along the full length, of the diaphragm beam 230-2. The closed cross-section member 403 may include upper and lower horizontal sides 408-1, 408-2, respectively, and opposite vertical sides 409-1 and 409-2.

The building assembly 400 may be used to implement the joint between two horizontally adjacent floor-ceiling panels (e.g., floor-ceiling panel 222-*a* and 222-*b*), a diaphragm beam (e.g., diaphragm beam 230-2), and one or more interior (i.e., demising) walls (e.g., walls 406-*a* and 406-*b*). Each of the floor-ceiling panels 222-*a*, 222-*b* may be implemented in accordance with any of the examples of pre-assembled floor-ceiling panels herein. For example, each of the floor-ceiling panels 222-*a*, 222-*b* may include a floor panel 226-*a*, 226-*b*, respectively, and a ceiling panel 228-*a*, 228-*b*, respectively, coupled to opposite sides of a panel frame that include a plurality of joists (e.g., joist 215-*a* and 215-*b* of panels 222-*a* and 222-*b*, respectively). The floor panels may define a floor side of a story or level of a building (e.g. an upper story of building 101) and the ceiling panels may define a ceiling side of a story or level immediately below the upper story.

Each of the panels 222-*a*, 222-*b* is adjacent to a vertical side 409-1, 409-2, respectively, of the diaphragm beam 230-2. In some examples, the panels 222-*a*, 222-*b* may be directly against (i.e., abutting) the respective vertical side of the beam 230-2. In other example, the panels 222-*a*, 222-*b* may be adjacent to but spaced from the respective vertical side of the beam 230-2, such as to accommodate additional layers 404 of material therebetween. For example, the additional layers 404 may include a thermally insulative material and/or a fire-resistant material, which may be sandwiched between the respective panel 222-*a*, 222-*b* and the respective vertical side of the beam 230-2. In some embodiments, the additional layers of material may be pre-assembled (e.g., fastened, bonded or otherwise attached) to the diaphragm beam 230-2 at the factory prior to delivery and assembly of the diaphragm beam to the building frame.

To assemble the floor-ceiling panel 222-*a*, for example, to the diaphragm beam 230-2, the panel 222-*a* may be positioned adjacent to the vertical side 409-1 of beam 230-2 and may then be coupled to the beam 230-2, for example by welding or mechanically fastening the panel 222-*a* to the beam 230-2. To that end, the panel 222-*a* may include a connector bracket 270-*a*, which may be implemented using one or more angle brackets (e.g., a L-shaped or T-shaped bracket), or differently-shaped brackets that extend continuously or discontinuously along some or substantially the full transverse edge of the panel 222-*a*, with one of the legs of the bracket extending outwardly from the panel's edge. The beam 230-2 may be pre-assembled or provided at the building site with a support bracket 232. The support bracket 232 may be implemented using one or more angle bracket (e.g., an L-shaped or T-shaped bracket), or differently-shaped bracket that extend continuously or discontinuously along some or substantially the full length of the beam 230-2, with one of the legs of the bracket extending outwardly from (e.g., perpendicularly to) the vertical side 409-1 of the beam. The beam 230-2 may be provide with support brackets 232 on both of the opposite vertical sides of the beam 230-2 so as to support a respective floor-ceiling panel at each of its vertical sides. The panel **222-*a* may be arranged with respect to the beam such that the bottom side of the panel 222-*a* (e.g., ceiling side prior to assembling a ceiling finish material thereto) rests on the support bracket 232 and such that the connector bracket 270-*a* of the panel 222-*a* rests on the upper horizontal side of the beam 230-2. The panel 222-*a* may then be joined to the beam 230-2, for example by fastening the outwardly (i.e., horizontally) extending portion of the support bracket 232 to the ceiling panel and/or panel frame of floor-ceiling panel 222-*a* and also by coupling (e.g., by fastening or welding) the outwardly extending portion of the connector bracket 270-*a* to the beam's upper horizontal side 408-1. It will be understood that a similar process may be performed to join the other floor-ceiling panel 222-*b* at the opposite vertical side of beam 230-2. As will be further understood, a floor system for each unit or room located on the opposite sides of beam 230-2 may be formed using a plurality of floor-ceiling panels (e.g., as shown and described with reference to FIGS. 2A and 2B), therefore a similar process may be performed to join each of the individual floor-ceiling panels to a respective side of beam 230-2**.

In some embodiments, e.g., to accommodate coupling the floor-ceiling panels in the manner described, the ceiling sides of the floor-ceiling panels **222-*a*, 222-*b* may be above the lower horizontal side 408-2 of the diaphragm beam 230-2. In such embodiment, the support bracket may have a leg that is joined (e.g., welded to the vertical side of the beam and forming a ledge above the lower horizontal side 408-2 of the beam. In other embodiments, the ceiling sides of the floor-ceiling panels 222-*a*, 222-*b* may be substantially in line with the lower horizontal side 408-2** of the beam. In such examples, the L-shaped bracket may have a leg that extends outward from the beam and is substantially aligned with the lower horizontal side of the beam, and a leg that is attached to the vertical side of the beam and extend vertically upward from the other let. Other arrangements may be used, such as coupling the support bracket at any other location along the vertical sides of the beam and/or to the lower horizontal side of the beam.

In some embodiments, the floor side of the pre-assembled floor-ceiling panels may be substantially in line or, in some example, above the upper horizontal side 408-1 of the diaphragm beam. In the case of the latter, the connector brackets **270-*a*, 270-*b* of the respective floor-ceiling panels 222-*a*, 222-*b* are attached to the transverse edge of the panels at a location below the upper or ceiling side of each panel. Thus when the panels 222-*a*, 222-*b* are rested onto the upper horizontal side 408-1 of the diaphragm beam 230-2, the ceiling side of the respective panel 222-*a*, 222-*b* is at least slightly above the upper horizontal side 408-1 of the diaphragm beam 230-2. In some embodiments, the connector brackets 270-*a*, 270-*b* are arranged such that the floor panel is substantially the only portion of the floor-ceiling panels that extends vertically above the upper horizontal side 408-1. This arrangement of components may increase the ease of aligning and/or coupling wall panels into the assembly, e.g., by defining a track between the horizontally adjacent panels for receiving a demising wall (e.g., wall 406-*a***).

In some embodiments, the building assembly may include at least two pre-assembled walls adjacent to opposite horizontal sides of the diaphragm beam. As shown in FIG. 4, in some embodiments, the at least two pre-assembled walls may be interior walls (e.g., demising walls **406-*a* and 406-*b*), each of which may include or be configured to support an interior finish material 309 on both sides of the wall. The pre-assembled walls may be implemented in accordance with any of the examples herein. For example, each demising wall may be pre-assembled to include, as delivered to the building site, some or all internal components, such as conduits 303 for fire suppression, HVAC, electrical, or other sub-systems) and insulative materials 301 (e.g., thermal insulation such as mineral wool bat insulation, and/or sound insulation) as may be desired to support use of the associated units or rooms defined on both sides of the interior wall. The internal components (e.g., conduits, insulation, etc.) may be substantially or at least partially enclosed within a cavity defined between opposite wall layers 305, each of which may be formed of mineral based materials such as cement board, magnesium oxide (MgO) board, fiber-cement board, gypsum board, fiberglass-clad cement or gypsum board, metal-clad cement or MgO board, and other suitable mineral-based materials. In some embodiments, additional insulation 307, such as semi-rigid mineral wool, may be placed externally to the layers 305. In some embodiments, the demising walls 406-*a*, 406-*b*, may include wall brackets 304 extending from one or more of the layers 305. The wall brackets 304 may be configured to support the finish material 309 in a spaced arrangement with respect to the layers 305 defining a cavity between the layers 305 and the finish material 309. In some embodiments, at least some of the sub-system components (e.g., electrical conduits and/or HVAC vents) may be located in this cavity. The wall brackets 304 may be configured to support the additional insulation 307 such as to maintain it in a desired location with respect to the layers 305. In some embodiments, the demising walls 406-*a*, 406-*b* may be pre-assembled and delivered to the building site with the interior finish material 309**, some of which, such as lower most and/or upper most portions, may be temporarily removed at the site, e.g., to facilitate installation of demising walls. In some embodiments, the demising wall may be implemented in accordance with any of the examples described in co-pending international patent application PCT/US17/21174, titled "Prefabricated Demising Wall with External Conduit Engagement Features," which application is incorporated herein by reference in its entirety for any purpose.

In some embodiments, for example as illustrated in FIG. 4, the demising walls **406-*a*, 406-*b* may be positioned directly over the diaphragm beam 230-2 and in some examples, may be fastened to the beam 230-2 and or the respective floor-ceiling panels. However, the demising walls 406-*a*, 406-*b* may be coupled to the diaphragm beam 230-2 in a manner so as not to transmit or carry any appreciable structural loads. As previously described, the pre-assembled walls may be non-loadbearing walls. As described, building or structural loads may be transferred directly from the diaphragm to the external structural frame, e.g., by load paths provided by the floor-ceiling panels and diaphragm beams, without any appreciable transference of structural loads to the walls. Thus, the connection or coupling between a demising wall and the diaphragm may be generally for positioning and retaining the demising wall in place rather than for providing a load path for structural loads (vertical and/or lateral loads experienced by the building). To that end, in some embodiments, the one or more pre-assembled walls may be non-rigidly coupled to the diaphragm beam, which may avoid or reduce the transference of structural loads to a non-loadbearing wall. In some embodiments, the non-rigid connection between the pre-assembled wall and the diaphragm beam may be achieved using a compressible material and/or a slidable joint between the wall and the diaphragm beams. In some embodiments, a non-rigid connection between the demising wall and the diaphragm may allow the diaphragm beam 230-2** and/or floor-ceiling panels to displace slightly relative to the demising wall, such as when carrying diaphragm loads, to avoid or reduce any significant transference of loads to the non-loadbearing wall.

For example, and referring to FIG. 4, the demising wall 406-*b* may be coupled to the lower horizontal side 408-2 of diaphragm beam 230-2 using a non-rigid connection 306. The diaphragm beam may be pre-assembled to include or provided at the building side with at least one bracket 401 extending vertically from the lower horizontal side 408-2 of the diaphragm beam 230-2. When assembling demising wall 406-*b* to the building, the lower portion of wall 406-*b* may be positioned over a diaphragm beam in the floor side and secured thereto (e.g., via brackets 412, which extend vertically upward from the upper horizontal side 408-1 of the diaphragm beam 230-2). At this point, in some embodiments, the upper diaphragm beam may not have been assembled, so the upper portion of wall 406-*b* may be free-standing or unattached to other structure until the diaphragm associated with the upper story has been installed.

When installing the upper diaphragm, an upper diaphragm beam (e.g., beam 230-2) may be positioned over the demising wall 406-*b* such that the brackets 401 engage the upper portion of the demising wall 406-*b*. The distance between the brackets 401 may be selected to accommodate at least part of the upper portion of the demising wall 406-*b* therebetween, in this example accommodating the wall-frame and layers 305 therebetween. That is, each of the brackets 401 may be positioned relative to the diaphragm bean and coupled thereto such as to accommodate at least the studs of the pre-assembled wall therebetween. In some cases, a shim may be inserted between the brackets and the demising wall portion that is sandwiched between the brackets 401. Each bracket 401 may be provided with a slot and a fastener may be received through the slot joining the bracket 401, and thus the beam 230-2, to the demising wall 406-*b* while still enabling the demising wall to displace vertically with respect to the beam 230-2 (i.e., by movement of the fasteners in the slots). Additionally and optionally a non-rigid material, such as semi-rigid insulation or a compliant material, may be provided between the opposing surfaces of the demising wall 406-*b* and the diaphragm beam 230-2. In other embodiments, the non-rigid connection may instead be provided at the lower portion of the demising wall.

While the illustrated example of a building assembly in FIG. 4 shows an arrangement which divides the upper and lower stories into four units or rooms, it will be understood that in some examples, one of the demising walls may be omitted, thus one of the stories may be divided into units/rooms at the location of the diaphragm beam, while the other story may have a unit or room that spans across the interface of the floor-ceiling panels with the diaphragm beam.

As with the upper portion of the demising wall, the lower portion of a demising wall (e.g., demising wall 406-*a*) may be coupled to both the diaphragm beam (e.g., via brackets 412) and to the floor panel (e.g., via trim pieces 414). To couple the lower portion of a demising wall to the diaphragm beam, the demising wall may be positioned vertically over the diaphragm beam and mechanically secured thereto. The brackets 412 may be pre-installed to the diaphragm beam (e.g., in the factory or at the building side) prior to positioning the wall 406-*a* onto the diaphragm beam. In such examples, at least part of the lower portion of demising wall 406-*a* (e.g., the studs and the lower portion of the layers 305) may be seated in the track defined between brackets 412, and then mechanically secured thereto by fastening through the brackets, layers 305, and into the studs of the wall. In other embodiments, the wall 406-*a* may be aligned and positioned at the desired location onto the diaphragm beam and the brackets 412 may be mechanically coupled (e.g., fastened or welded) to both the wall 406-*a* and the beam 230-2. In yet other embodiments, the brackets 412 may be pre-installed on the wall (e.g., at the factory) before installing the wall to the diaphragm beam. In such examples, the brackets 412 may be used to align and set the wall in the desired location with respect to the beam 230-2. In some examples, the brackets 412 may be L-shaped, T-shaped, Z-shaped (e.g., with a portion extending vertically down along a vertical side of the diaphragm beam and a portion extending vertically up from the horizontal side of the beam), or otherwise suitably shaped for joining the wall 406-*a* to the beam 230-2.

As shown, the outer sides of the pair of wall boards or layers 305 may define a distance therebetween, which is narrower than the distance between the edges of the horizontally adjacent floor-ceiling panels. Thus, the demising wall may be configured such that the lower portion thereof can be received and may sit at an elevation below the upper or floor side of the floor-ceiling panels. The interior finish panels, on the other hand, may define a distance therebetween which is wider than the gap between the two floor-ceiling panels and thus, the finish panels may at least partially overlap the floor side of the floor-ceiling panels when installed, thereby enabling a joint between the wall and floor-ceiling panel that provides an aesthetically pleasing look.

FIGS. 5A-5D show additional aspects of building assemblies according to the present disclosure. As described, the diaphragm beam of a building assembly according to the present disclosure may be coupled at its opposite ends to the external structural frame. The various components and arrangement thereof shown in FIGS. 5A-5D are merely illustrative, and other variations, including eliminating components, combining components, and substituting components, or rearranging components are all contemplated. FIGS. 5A-5D show exemplary arrangements of components for coupling diaphragm beam 230-2 to the external structural frame. For example, the arrangement of components shown in FIGS. 5A and 5B may be used join one end of diaphragm beam 230-2, as indicated by dashed line 5-1 in FIG. 2B, to the external frame 210. The arrangement of components shown in FIGS. 5C and 5D may be used join the opposite end of diaphragm beam 230-2, as indicated by dashed line 5-2 in FIG. 2B, to the external frame 210.

Figure 5A:
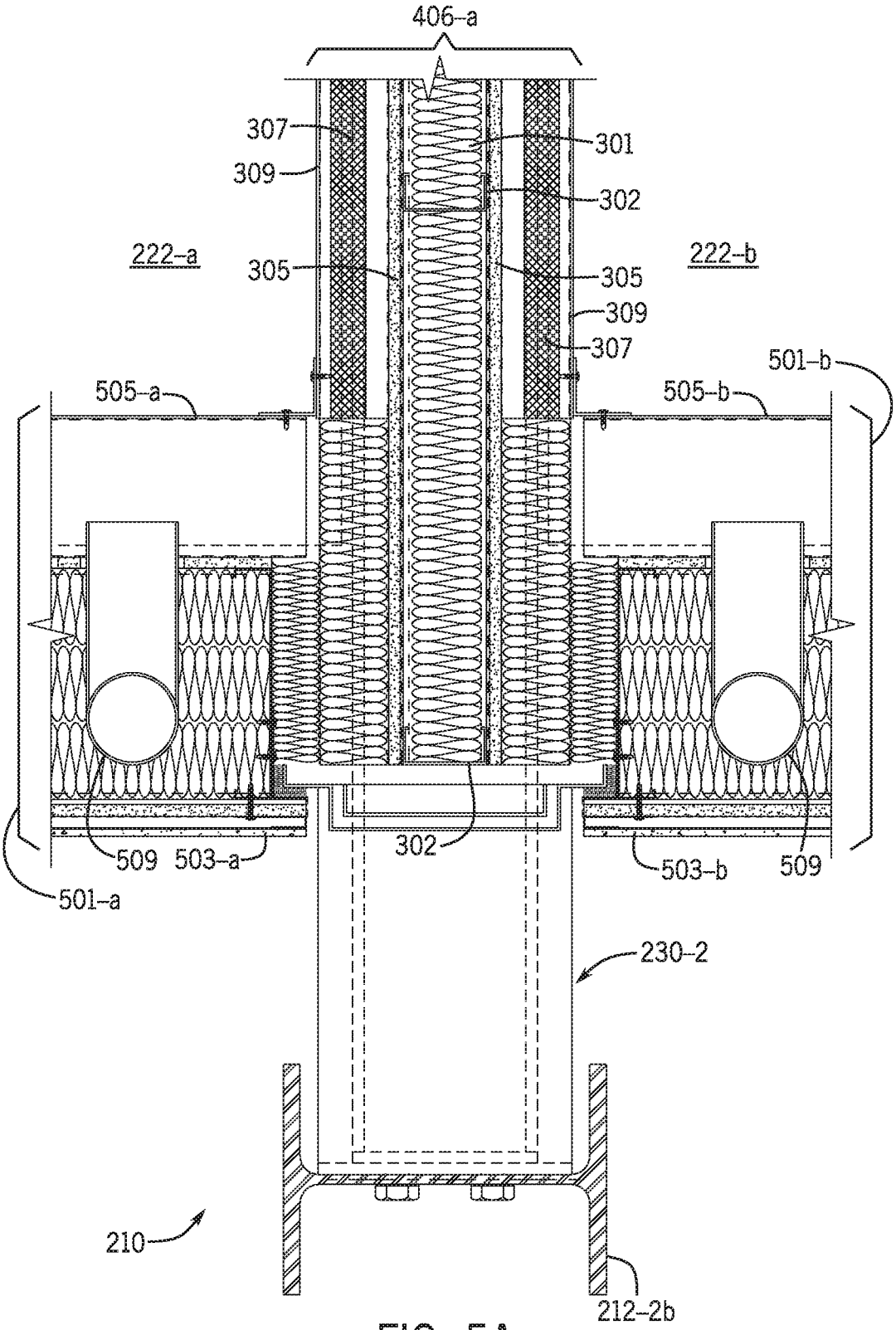
FIGS. 5A-5D are partial cross-sectional views taken at various elevations of a building and showing interfaces between one or more pre-assembled walls and/or a diaphragm beam.

Referring now also to FIG. 5A, the pre-assembled wall (e.g., demising wall 406-*a*) may include wall panels or layer 305 attached to opposite sides of a wall-frame that includes a plurality of studs 302. The studs 302 extend perpendicular to the diaphragm beam 320-2 when the pre-assembled wall (e.g., demising wall 406-*a*) is coupled thereto. As also described, the pre-assembled wall (e.g., demising wall 406-*a*) may further include one or more brackets (not visible in the view in FIG. 5A) attached to the outer sides of the wall panels or layers 305 and which are configured to support the interior finish layer(s) 309 in a spaced arrangement with respect to the wall panels or layers 305. The pre-assembled wall may be pre-assembled to also include a sprinkler conduit (see e.g., conduit 303 of demising wall 406-*b* in FIG. 4) extending through the cavity defined between the wall panels or layers 305 and protruding beyond the outer side of the at least one of the wall panels or layers 305.

Additional walls (e.g., an end wall, a window wall, etc.) may be coupled vertically to the diaphragm to seal the envelope of the building. In some embodiments, the building assembly may include one or more additional pre-assembled walls, for example one or more utility walls 501-*a*, 501-*b* as shown in FIG. 5A, which may be arranged and coupled perpendicular to the demising wall (e.g., was 406-*a*) and the floor panels 222-*a*, 222-*b*. In some embodiments, the utility walls may be envelope walls, and as such may be pre-assembled to include or be provided at the building site with exterior cladding materials 503-*a*, 503-*b* on one side and an interior finish layers 505-*a*, 505-*b* on the opposite interior side of the wall. The pre-assembled utility wall may include one or more plumbing conduits 509 for providing plumbing utility to the units/room on each side of the demising wall. The utility wall may also include insulative materials and other internal components (e.g., electrical conduits, etc.) as may be needed to support various sub-systems of the building. In some embodiments, two utility walls may be arranged on opposite sides of an interior or demising wall. The interior or demising wall may extend between the two utility walls (e.g., as shown in FIG. 5A), for example through most or substantially all of the thickness of the utility walls. The interior wall (e.g., demising wall 406-*a*) may include one or more layers of insulation and/or be configured to accommodate insulative material in the space between the interior wall and the opposing sides of the two utility walls, which may further improve the thermal and acoustic insulation between the units/rooms located on the opposite sides of the demising wall.

Figure 5B:
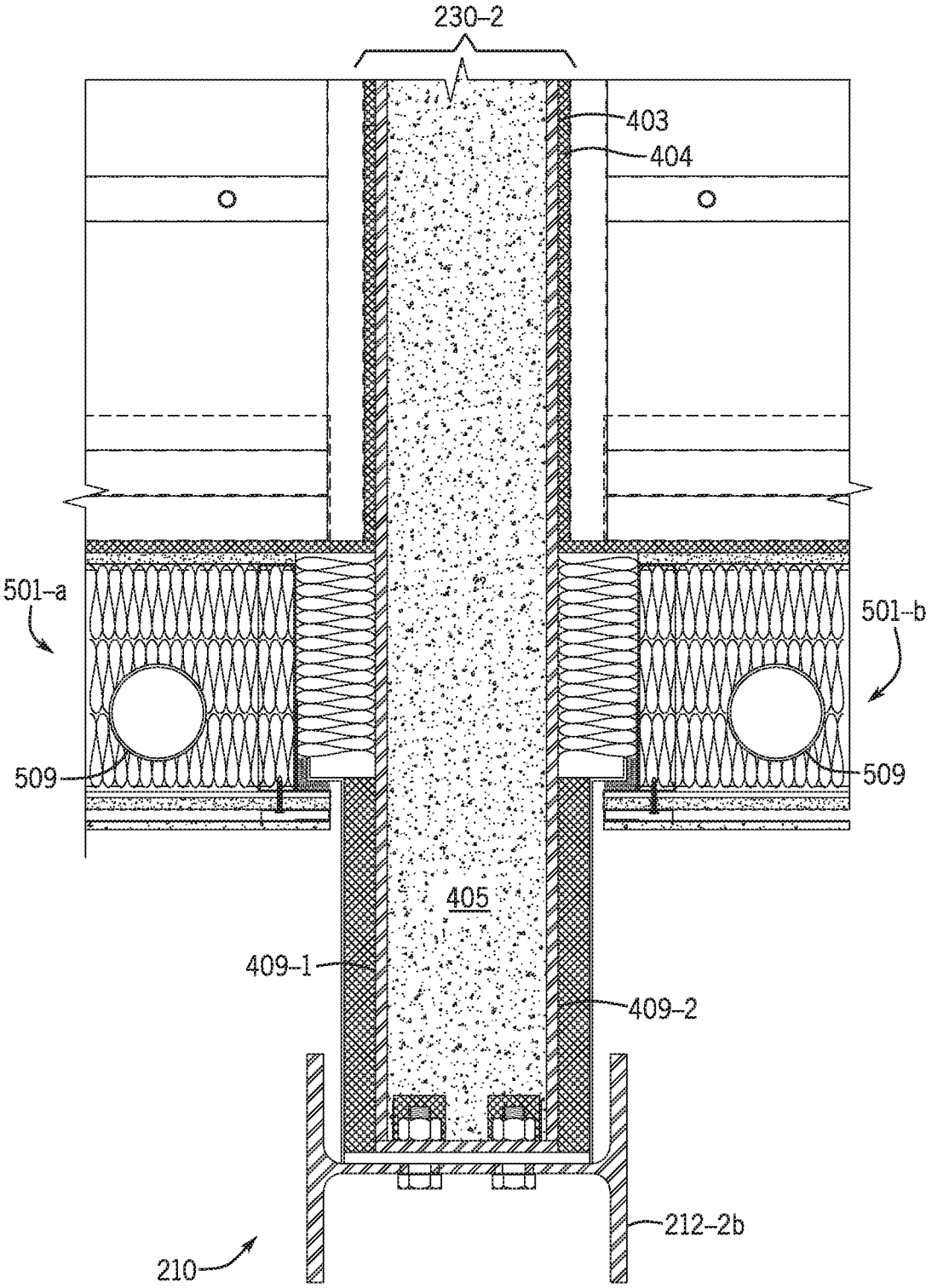
Figure 5C:
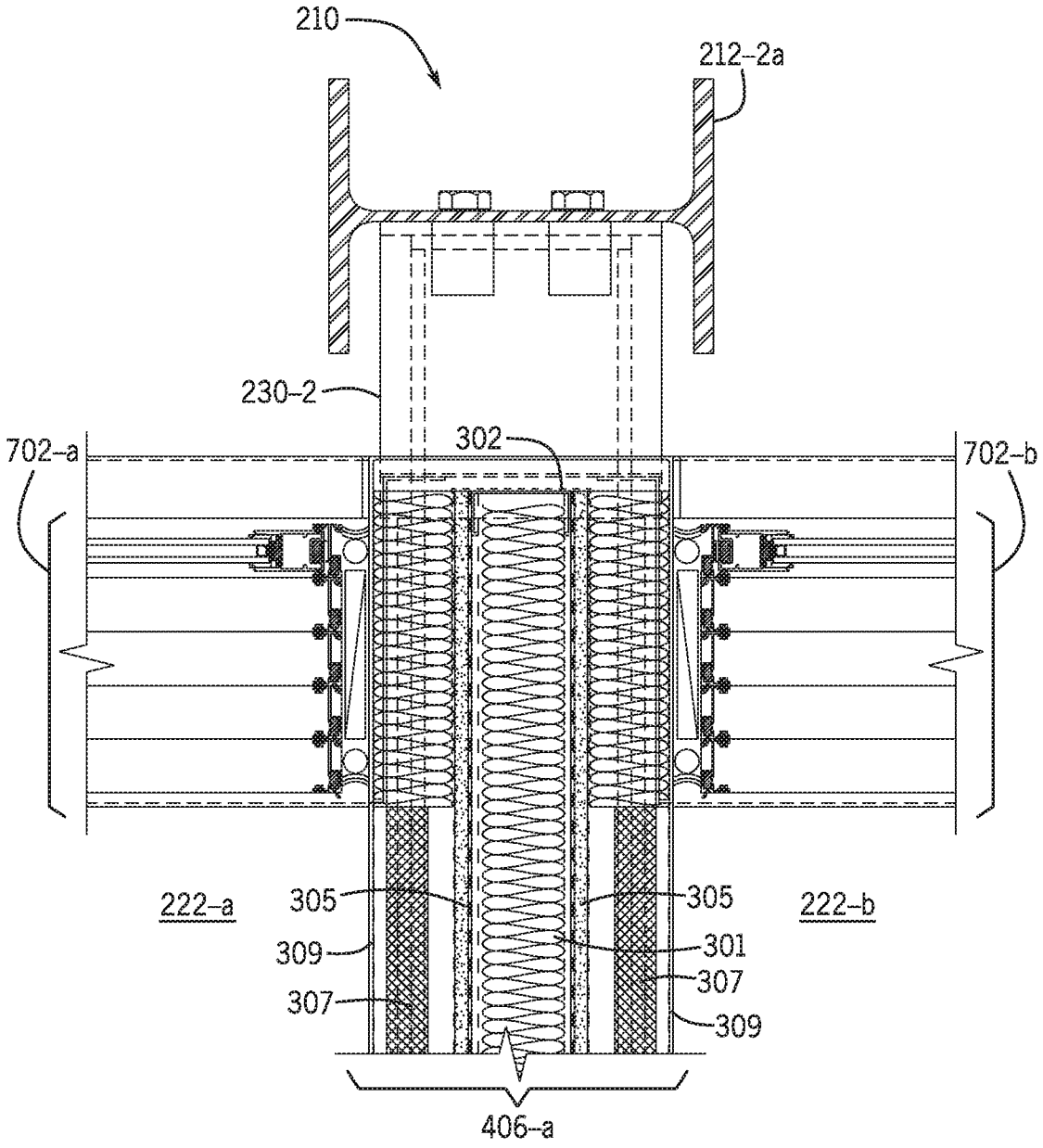
Figure 5D:
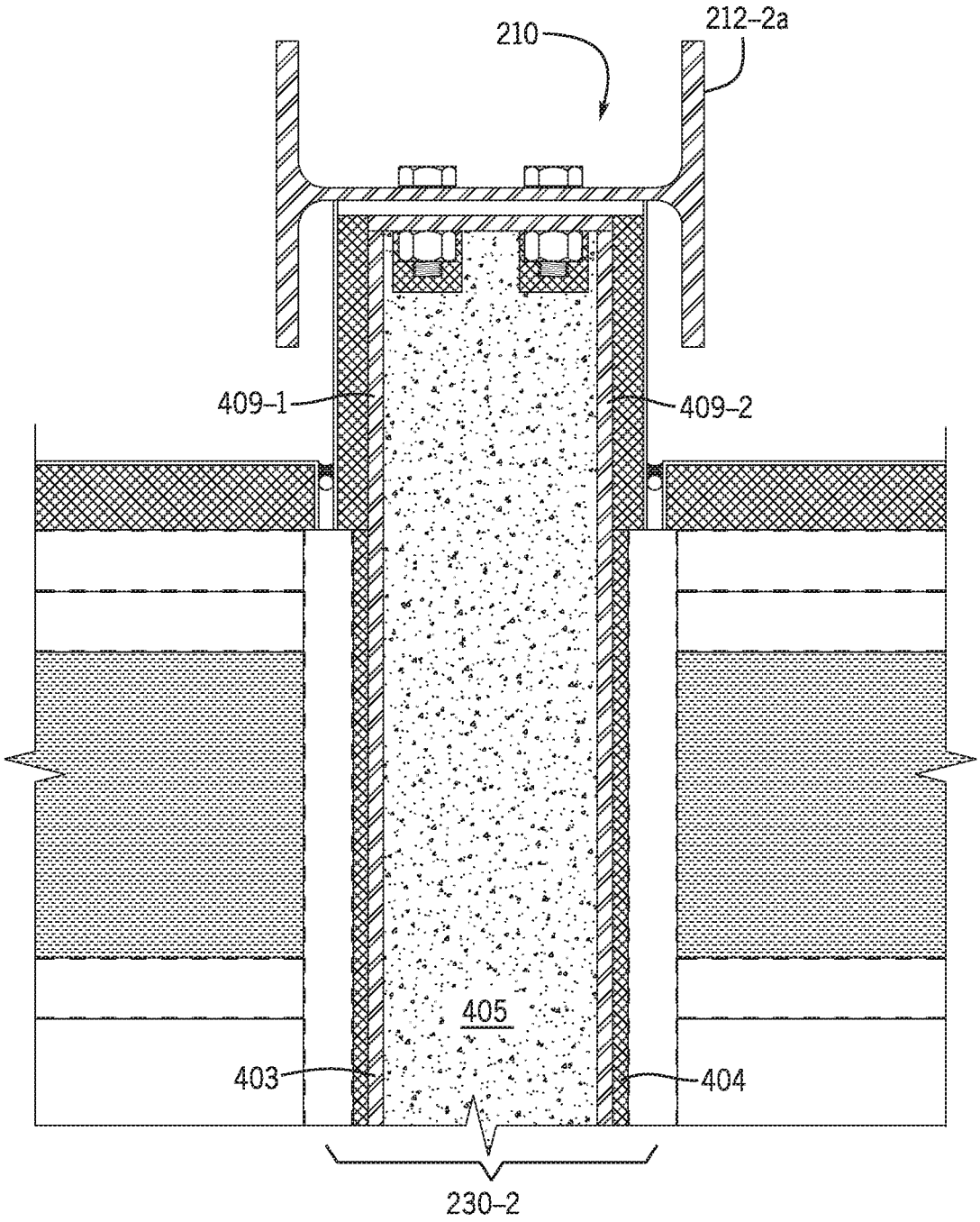

Additionally, as shown in FIG. 5C, window walls 702-*a*, 702-*b*, which may be formed by floor-to-ceiling window panels, may be provided opposite the utility walls at the other end of the demising wall. FIGS. 5B and 5D shows portions of the building assembly at the same general locations as in FIGS. 5A and 5C (e.g., at the locations indicated by 5-1 and 5-2 in FIG. 2B) but at different vertical elevations, specifically to illustrate cross-sectional views through the diaphragm beam at these location showing the interior of the beam which is filled with a mineral-based material 405.

Figure 6:
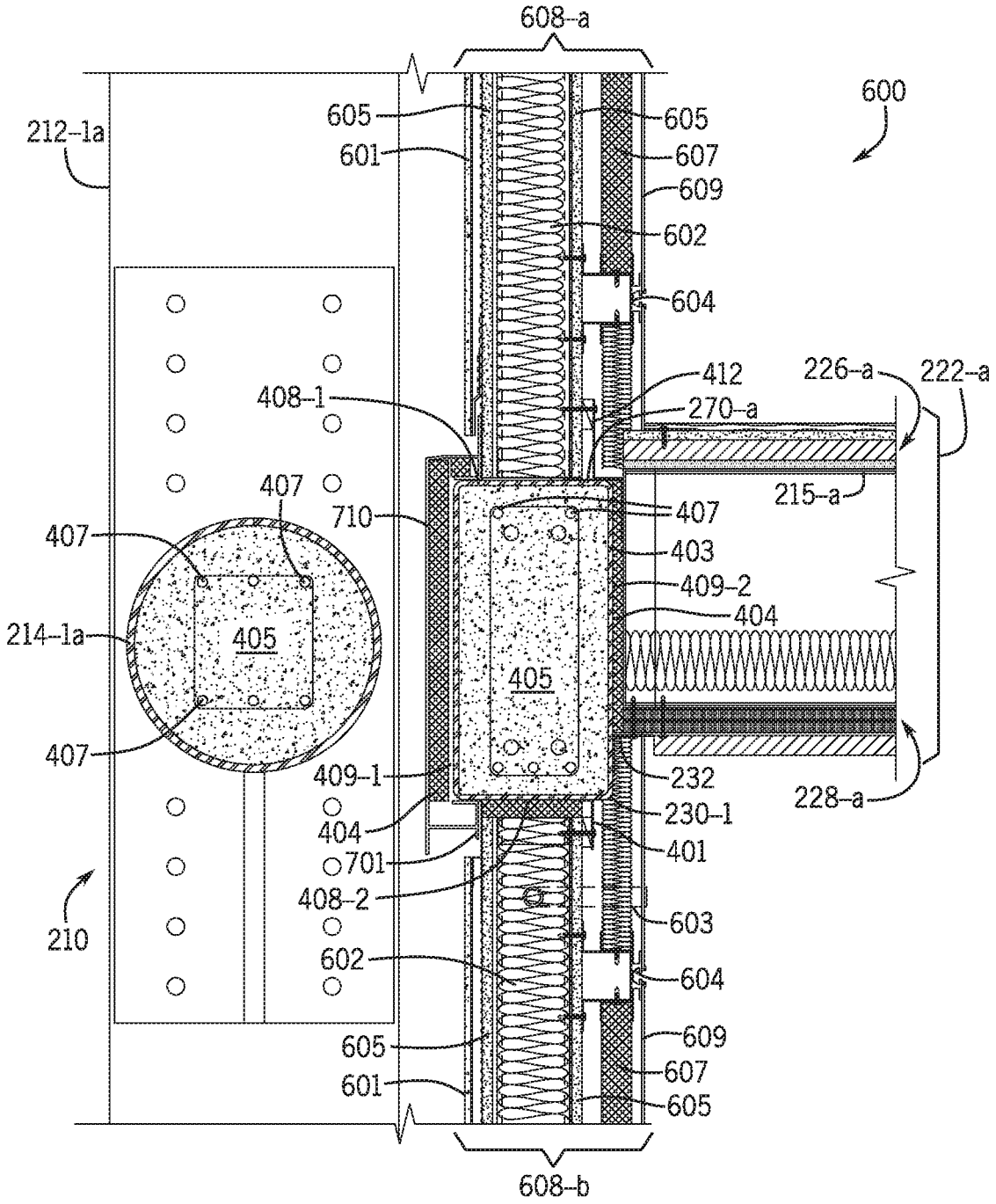
FIG. 6 is another partial cross-sectional view of a building assembly showing an interface between vertically adjacent pre-assembled walls and a pre-assembled floor-ceiling panel coupled thereto.

FIG. 6 illustrates a cross-sectional view of a portion of a building assembly according to further embodiments of the present disclosure. FIG. 6 shows a building assembly 600 including floor-ceiling panel 222-*a* and end walls 608-*a* and 608-2, all coupled to diaphragm beam 230-1. The components of building assembly 600 and arrangement thereof shown in FIG. 6 are merely illustrative, and other variations, including eliminating components, combining components, and substituting components, or rearranging components are all contemplated.

The building assembly 600 may include a diaphragm beam 230-1, which in some embodiments may be filled with a mineral-based material 405, e.g., concrete, and/or other type of non-combustible or fire-resistant material. Similar to diaphragm beam 230-2, the diaphragm beam 230-1 may be implemented using an elongate, closed cross-section member 403, such as a steel, hollow structural section (HSS) beam, and which encloses the mineral-based material 405 or other type of non-combustible or fire-resistant material. Filling the interior of the diaphragm beams with a mineral-based or other type of non-combustible or fire-resistant material may enable the beam 230-1 to meet fire code, and thus obviate the need to use other types of fire resistant treatments (e.g., intumescent paint, spray on insulation, etc.). Also, the filling of the diaphragm beam with a mineral-based material may provide improved load-carrying capability which may enable the construction of a diaphragm that is not supported by beams along at least some edges (e.g., the longitudinal edges) of the diaphragm. In some embodiments, the diaphragm beam 230-1 may include an at least one reinforcing member 407 embedded in the mineral-based material 405. For example, the reinforcing member(s) may include one or more elongate metal rods (e.g., rebar) which extend along at least a portion of, and in some cases along the full length, of the diaphragm beam 230-1. The closed cross-section member 403 may include upper and lower horizontal sides 408-1, 408-2, respectively, and opposite vertical sides 409-1 and 409-2. In some embodiments, one or more of the beams of the external structural frame, e.g., frame beam 214-1*a*, may also be filled with a mineral-based material 405, such as concrete, and/or internally reinforced by reinforcing member(s) embedded in the mineral-based material, which may enhance the loadbearing capability of the structural frame and/or provide other advantages.

The building assembly 600 may be used to implement the joint between two vertically adjacent end walls (e.g., end walls 608-*a* and 608-*b*), a diaphragm beam (e.g., diaphragm beam 230-1, which in the context of this discussion may also be referred to as end diaphragm beam), and a floor-ceiling panel (e.g., floor-ceiling panel 222-*a*) terminating at the diaphragm beam. The floor-ceiling panel 222-*a* is arranged adjacent to one of the vertical sides, in this case vertical side 409-2 of the end diaphragm beam 230-1, and the end walls 608-*a* and 608-*b* are each positioned adjacent to the respective horizontal side 408-1 and 408-2 of the end diaphragm beam 230-1. As with the example in FIG. 4, the floor-ceiling panel 222-*a* in assembly 600 may be directly against (i.e., abutting) the vertical side of the beam 230-1, or it may be adjacent to but spaced from the beam 230-1, such as to accommodate additional layers of material 404 (such as thermally insulative and/or a fire-resistant material) therebetween. In some embodiments, the additional layers of material may be pre-assembled (e.g., fastened, bonded or otherwise attached) to the diaphragm beam 230-1 at the factory prior to delivery and assembly of the diaphragm beam to the building frame. For example, the diaphragm beam 230-1 may be delivered to the building site with the outer material 404 disposed adjacent to vertical side 409-1 pre-assembled to the beam, in some cases being held in attachment to the beam 230-1 by a water-impermeable member 710 that may be bonded or otherwise fastened to the beam 230-1. In some embodiments, the material 404 along at least one side of the beam (e.g., the interior vertical side 409-2) may be installed at the building site prior to or concurrently with installing the floor-ceiling panels.

The water-impermeable member 710 may be an elongate member coupled to the diaphragm beam 230-1 such that it covers the outer vertical side 409-1 of diaphragm beam 230-1. The water-impermeable member may thus be used to seal the envelope, e.g., by waterproofing the joint between upper and lower exterior or envelope walls and/or thermally insulating an otherwise thermally conductive metal beams. In some examples, the water-impermeable member 710 may be an elongate member fabricated as an extrusion or a pultrusion from a plastic or composite material (e.g., a fiber reinforced plastic (FRP)). In some embodiments, the elongate member may cover at least a portion of the upper and/or lower horizontal sides of the diaphragm beam. In some embodiments, the elongate member may include a vertically extending flange configured to be received between an exterior cladding layer and a stud of the pre-assembled wall. In some embodiments, the elongate member may be coupled to the diaphragm beam such that it defines a cavity between the elongate member. The cavity may provide thermal insulation. In some examples, the cavity may contain a thermally-insulative material such as semi-rigid mineral wool, a thermal blanket material or the like.

To assemble the floor-ceiling panel 222-*a* to the end diaphragm beam 230-1, the panel 222-*a* may be positioned adjacent to the interior vertical side 409-2 of beam 230-1 and may then be coupled to the beam 230-1, for example by welding or mechanically fastening the panel 222-*a* to the beam 230-1. As will be appreciated, this may occur concurrently with the arranging of the floor-ceiling panel 222-*a* to the intermediate diaphragm beam 230-2, such as by vertically dropping the panel 222-*a* in the space defined by the beams 230-1 and 230-2 and resting the panel 222-*a* onto the support brackets of the respective beams 230-1 and 230-2. Similar to beam 230-2, the end diaphragm beam 230-1 may include a support bracket an L-shaped or T-shaped bracket, or differently-shaped bracket) that extend continuously or discontinuously along some or substantially the full length of the beam 230-1, with one of the legs of the bracket extending outwardly from (e.g., perpendicularly to) the vertical side 409-2 of the beam to support the edge of the panel 222-*a*. The support brackets may be pre-installed (e.g., in the factory) on the beam or installed thereto at the building site. As described with respect to the opposite side of panel 222-*a*, the panel 222-*a* may include another connector bracket 271-*a* (e.g., a L-shaped, T-shaped bracket, or differently-shaped bracket, that has a portion extending outwardly from the panel's edge) for coupling the panel 222-*a* also to the end diaphragm beam 230-1. Once the panel 222-*a* is placed in position (e.g., rested onto support brackets of the beams), the connector brackets 271-*a*, and 270-*a* previously described, may be joined to the beam, such as by welding or mechanically fastening the brackets, for example to the upper horizontal side of the respective beam. When multiple floor-ceiling panels form the floor system for a given unit or room, the multiple floor-ceiling panels may each be individually jointed to the end diaphragm beam in a similar manner. In the illustrated example, the ceiling side of the floor-ceiling panel 222-*a* is above the lower horizontal side 408-2 of the diaphragm beam 230-1, and the floor side of the floor-ceiling panel 222-*a* is slightly above the upper horizontal side 408-1 of the diaphragm beam 230-1, however a different arrangement may be used in other embodiments, such as by configuring the components and coupling the floor-ceiling panel 222-*a* at a different vertical elevation relative to the diaphragm beams.

As shown in the illustrated example in FIG. 6, the assembly 600 may include at least two vertically adjacent pre-assembled walls, in this case end walls 608-*a* and 608-*b*. The end walls 608-*a* and 608-*b* are each arranged adjacent to a horizontal side of the end diaphragm beam 230-1. As an exterior or envelope wall, each of the pre-assembled end walls 608-*a* and 608-*b* may be pre-assembled to include or be configured to support an interior finish material 609 on one side of the wall and an exterior finish material 601 (e.g., cladding) on the opposite exterior side of the wall. As described, each pre-assembled wall may be pre-assembled to include, as delivered to the building site, some or all of the internal components, such as conduits (e.g., sprinkler 603 for fire suppression, HVAC, electrical, or other sub-systems) and insulative materials 602 (e.g., thermal insulation such as mineral wool batt insulation, and/or sound insulation) as may be desired to support use of the associated units or rooms. The internal components (e.g., conduits, insulation, etc.) may be substantially or at least partially enclosed within a cavity defined between opposite wall layers 605, each of which may be formed of mineral based materials such as cement board, magnesium oxide (MgO) board, fiber-cement board, gypsum board, fiberglass-clad cement or gypsum board, metal-clad cement or MgO board, and other suitable mineral-based materials. In some embodiments, additional insulation 607, such as semi-rigid mineral wool, may be provided on the interior side of the wall, between the layers 605 and the finish material 609. Similar to the demising walls, wall brackets 604 may extend from one or more of the layers 605 e.g., to support the finish material 609 in a spaced arrangement with respect to the layers 605.

The end walls 608-*a* and 608-*b* may be non-loadbearing and may thus be coupled to the diaphragm in a manner so as not to transmit or carry any appreciable structural loads. As described, building or structural loads may be transferred directly from the diaphragm to the external structural frame, e.g., by load paths provided by the floor-ceiling panels and diaphragm beams (see for example, the diaphragm to frame joints in FIGS. 7A and 7B), without any appreciable transference of structural loads to the walls. Thus, the connection or coupling between an end wall and the diaphragm may be generally for positioning and retaining the end wall in place rather than for providing a load path for structural loads (vertical and/or lateral loads experienced by the building). A non-rigid connection between the end-wall and diaphragm may be achieved, for example, by using a compressible material and/or a movable connection between the end wall and diaphragm beam. In some embodiments, a non-rigid connection between the demising wall and the diaphragm may allow the diaphragm beam 230-1 and/or floor-ceiling panels to displace slightly relative to the end wall and thereby avoid or reduce any significant transference of loads to the non-loadbearing wall.

For example, the non-rigid connection may be implemented using a bracket 401 which is attached to the lower horizontal side 408-2 of beam 230-1 and includes a slot in the vertically extending portion of the bracket 401. The diaphragm beam 230-1 may be pre-assembled to include the bracket 401 or the bracket 401 may be installed to the beam at the building side. When assembling an end wall, for example end wall 608-*b*, to the building, the lower portion of end wall 608-*b* may be positioned over the diaphragm beam 230-1 and secured thereto (e.g., via brackets 412, which extend vertically upward from the upper horizontal side 408-1 of diaphragm beam 230-1). The joining of at least some of the pre-assembled walls (e.g., the end walls and demising walls) would typically occur after the supporting diaphragm (e.g., diaphragm beams and floor-ceiling panels associated with the floor system of a given story) has been installed but prior to the upper diaphragm (e.g., diaphragm beams and floor-ceiling panels associated with the ceiling system of a given story) have been installed. After certain ones of the pre-assembled walls (e.g., end walls and demising walls) have been erected and joined to the floor system, the upper diaphragm may be installed, e.g., by installing diaphragm beams over the free ends of the walls and coupling floor panels to and between the diaphragm beams.

For example, an upper diaphragm beam (e.g., end beam 230-1) may be positioned over an end wall 608-*b* such that the bracket 401 and the vertically extending portion 701 of member 410 engage the upper portion of the end wall 608-*b*.

The distance between the bracket 401 and portion 701 may be selected to accommodate at least part of the upper portion of the end wall 608-*b* (e.g., at least the upper ends of studs 606, and in some cases the upper ends of the studs and the wall panels 605) therebetween. The joints between the beam 230-1 and end walls 608-*a*, 608-2-*b* may be shimmed as needed. A vertically aligned slot may be provided in the vertically extending portion of bracket 401 such that the bracket can move relative to the upper portion of wall 608-*b* while remaining attached to one another (e.g., via one or more fasteners passing through the slot). The vertically extending portion 701 of member 410 may be adjacent to, and in some cases abut, the exterior side of the wall 608-*b* but may not be otherwise fixed to the exterior side of the wall 608-*b* to allow for relative movement between the beam 230-1 and wall 608-*b*. Additionally and optionally a non-rigid material, such as semi-rigid insulation or a compliant material, may be provided between the opposing surfaces of the demising wall 608-*b* and the diaphragm beam 230-1. The opposite side of the end wall, in this case the lower side of the end wall, may be rigidly joined to the supporting diaphragm beam (e.g., via a bracket such as an L-shaped, T-shaped, Z-shaped, or other suitably shaped bracket having at least a portion extending upward from the beam). In some embodiments, the location of the rigid and non-rigid connections may be reversed (e.g., the non-rigid connection may instead be provided at the lower end of the end wall).

Figure 7A:
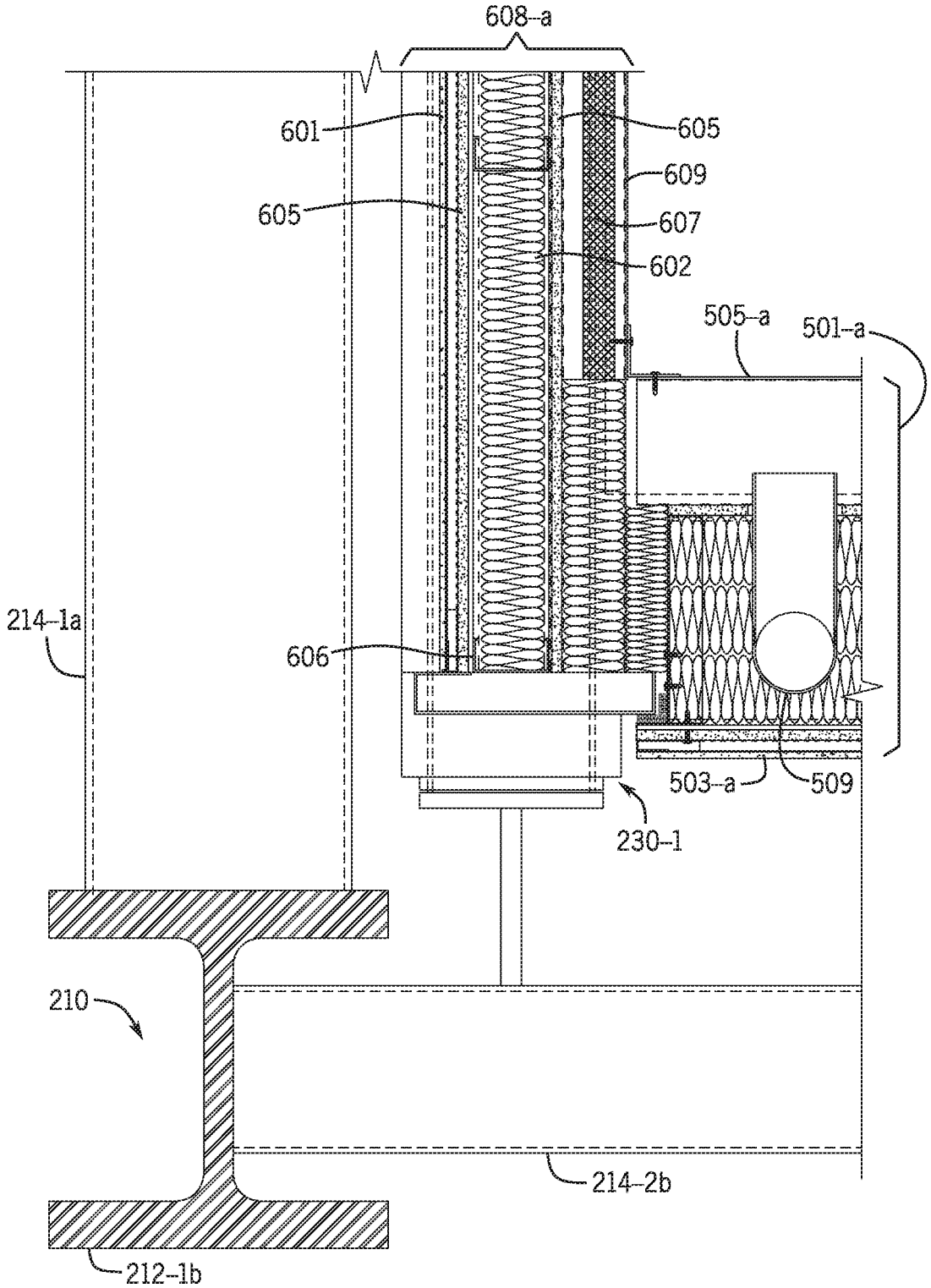
FIGS. 7A and 7B are partial cross-sectional views showing interfaces between perpendicularly arranged pre-assembled walls and arrangement of diaphragm components in relation to the external frame.
Figure 7B:
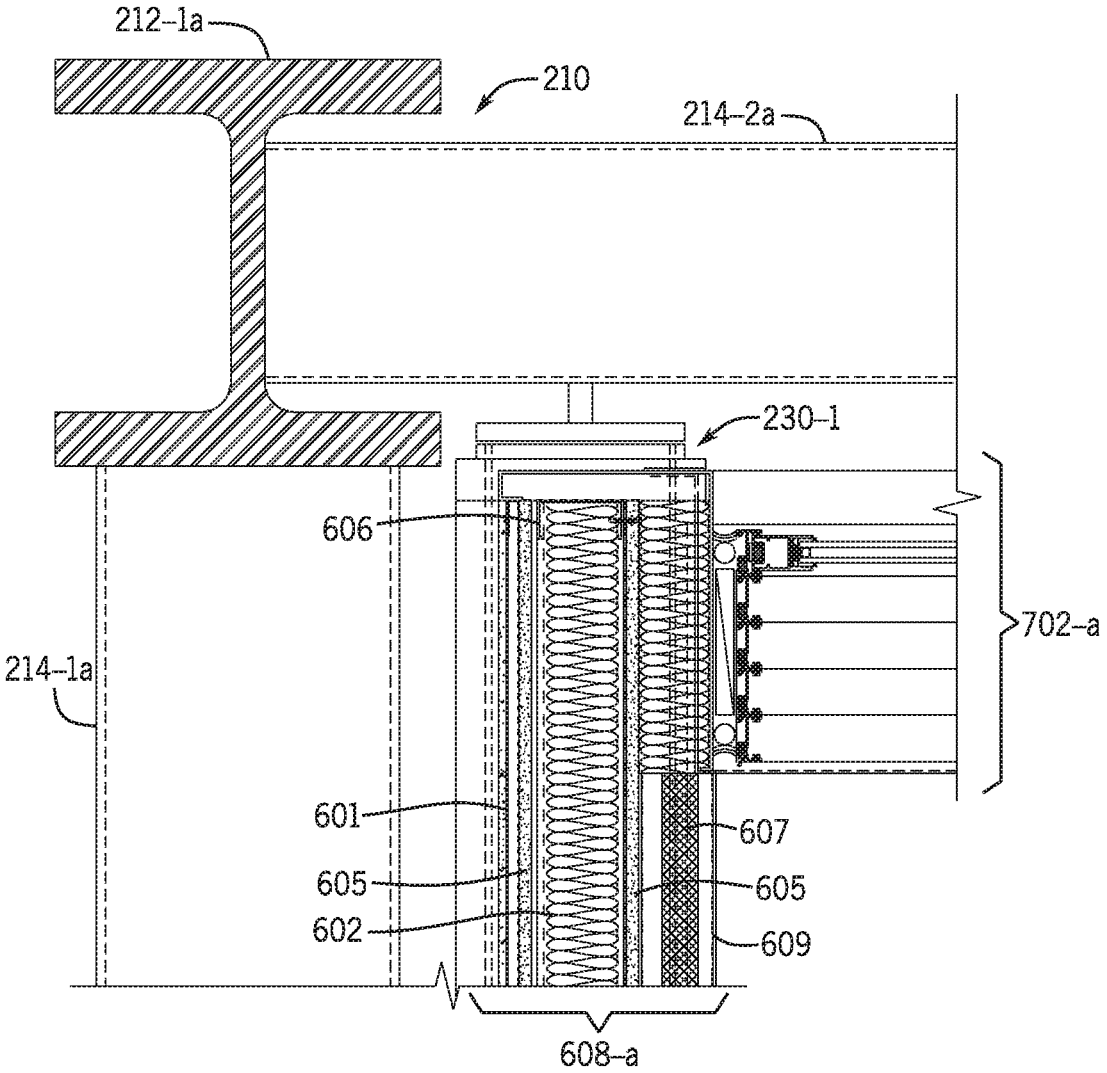

FIGS. 7A and 7B show additional aspects of building assemblies according to the present disclosure. As described, the diaphragm beam of a building assembly according to the present disclosure may be coupled at its opposite ends to the external structural frame. The various components and arrangement thereof shown in FIGS. 7A and 7B are merely illustrative, and other variations, including eliminating components, combining components, and substituting components, or rearranging components are all contemplated. FIGS. 7A and 7B show exemplary arrangements of components for coupling an end diaphragm beam 230-1 to the external structural frame 210. For example, the arrangement of components shown in FIG. 7A may be used join one end of the diaphragm beam 230-1, as indicated by dashed line 7-1 in FIG. 2B, to the external frame 210, and the arrangement of components shown in FIG. 7B may be used join the opposite end of diaphragm beam 230-1, as indicated by dashed line 7-2 in FIG. 2B, to the external frame 210.

In some embodiments, the building assembly 600 may include one or more additional pre-assembled walls, for example utility wall 501-*a* as shown in FIG. 7A, which may be arranged and coupled perpendicular to the end walls. Similar to end wall 608-*a*, the utility wall 501-*a* may, in some embodiments, be an envelope walls, and as such may be pre-assembled to include or be provided at the building site with exterior cladding materials 503-*a* on the exterior side of the wall. The opposite side may include or be configured to support an interior finish material 505-*a* (e.g., tile or other suitable interior finish layers). The pre-assembled utility wall may include one or more plumbing conduits 509 for providing plumbing to the associated units/rooms. As shown in FIG. 7B, a window wall 702-*a* may be installed opposite the utility wall. The window wall 702-*a* may be formed by floor-to-ceiling window panels, each of which may be individually connectable to window track pre-installed (e.g., in the factory) on the supporting floor and ceiling panels.

A building assembly in accordance with further embodiments of the present disclosure may include a pair of diaphragm beams (e.g., diaphragm beams 230-1 and 230-2), each filled with a mineral-based material and each having opposite ends connected to an external structural frame of a building. The building assembly may further include at least one a pre-assembled floor-ceiling panel (e.g., panel 222-*a*) which is arranged between and coupled to the pair of diaphragm beams. The pre-assembled floor-ceiling panel (e.g., panel 222-*a*) may span the full distance between the diaphragm beams (e.g., have a longitudinal length which is substantially the same as the distance between the diaphragm beams), and in some embodiments, multiple such The pre-assembled floor-ceiling panel may be arranged along the transverse direction (e.g., along the length of the pair of diaphragm beams) to form a diaphragm (e.g., diaphragm section 220-1 in FIG. 2B. The building assembly may further include a first pre-assembled wall, for example an interior wall (e.g., demising wall 406-*a*), coupled to a horizontal side of one of the pair of diaphragm beams (e.g., to upper horizontal side 408-1 of diaphragm beam 230-2. The building assembly may further include a second pre-assembled wall, for example an exterior (i.e., envelope) wall (e.g., end wall 608-*a*), coupled to a respective horizontal side of the other one of the pair of diaphragm beams (e.g., to upper horizontal side 408-1 of diaphragm beam 230-1). The first and second pre-assembled walls may be associated with one story (for example an upper story of a building), and in a multi-story construction, additional such first and second pre-assembled walls may be coupled to the opposite horizontal sides of the respective diaphragm beams 230-2 and 230-1. As described, the diaphragm may be formed using a plurality of pre-assembled floor-ceiling panels, thus in embodiments, the building assembly may include a plurality of pre-assembled floor-ceiling panels extending between the first and second pre-assembled walls (e.g., as shown in FIGS. 2A and 2B).

Figure 8:
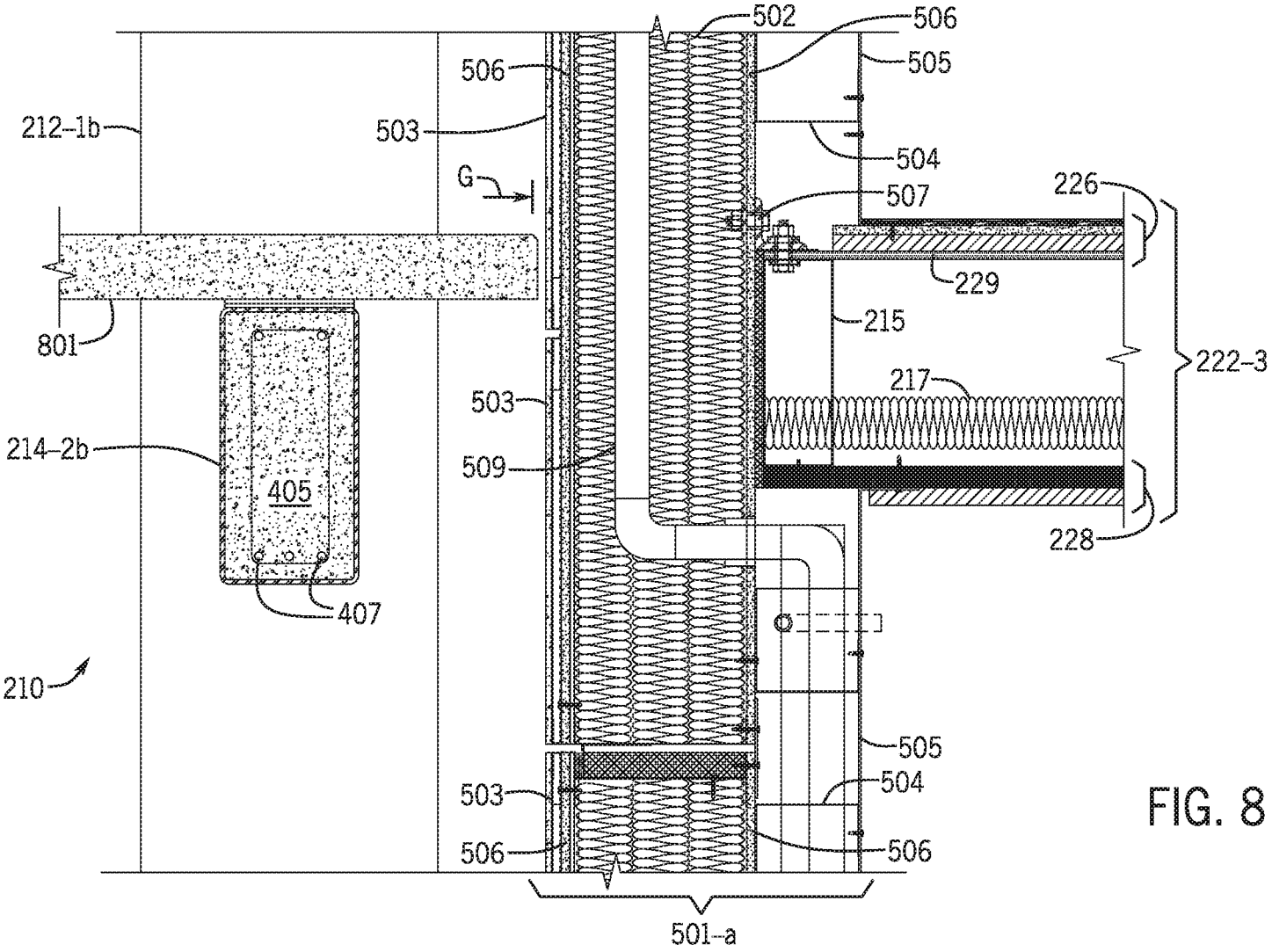
FIG. 8 is a partial cross-sectional view of an assembly showing an interface between a pre-assembled utility wall and a pre-assembled floor-ceiling panel and connection between vertically adjacent pre-assembled utility walls.

In some embodiments, the building assembly may further include another pre-assembled wall connecting the first and second pre-assembled walls and which includes one or more plumbing conduits. For example, FIG. 8 shows an elevational cross-sectional view through a floor-ceiling panel and associated portions of utility walls in accordance with some examples herein. The interface shown in FIG. 8 may be used to implement the joint between the floor-ceiling panel 222-3 and one or more utility walls, e.g., as shown by cross-section line 8-8 in FIG. 2B. FIG. 8 shows floor-ceiling panel 222-3, utility walls 501-*a* and 501-*b*, column 212-1*b*, frame beam 214-2*b*, exterior floor surface 801, and various internal components of the pre-assembled floor-ceiling panel and the pre-assembled utility walls 501-*a* and 501-*b*. The various components and arrangement thereof shown in FIG. 8 are merely illustrative, and other variations, including eliminating components, combining components, and substituting components, or rearranging components are all contemplated.

As shown in FIG. 8, the external frame 210 may include a vertically extending column 212-1*b* and a horizontally extending frame beam 214-2*b*, which in some embodiments may be implemented using a hollow cross section member similar to the diaphragm beams. However, as shown the frame 210 is not connected to the diaphragm (e.g., to floor-ceiling pane 222-3) at locations other than the joints between the diaphragm beams and the frame 210. The frame beam 214-2*b* may support an exterior floor surface 801 such as may be part of a courtyard or breezeway, and which may be coupled to the external frame after the utility walls 501-*a* and 501-*b* have been installed. The exterior floor surface 801 may be pre-cast concrete slab which is set onto the frame beam 214-2*b* after the installation of the utility walls. The exterior floor surface 801 may be positioned on the beam 214-2*b* and relative to utility wall 501-*b* such that a gap G remains between the exterior floor surface 801 and the exterior cladding 503 of the utility wall 501-*b*, e.g., to avoid the transference of any loads from the exterior floor surface 801 to the wall 501-*b*. In some embodiments, a gap of about ½ inch or in some cases more may be left between the exterior floor surface 801 and the exterior cladding 503 of the utility wall 501-*b*. In some embodiments, the frame beam 214-2*b* may be filled with a mineral-based material 405, such as concrete, and may include one or more embedded reinforcing members 407, which may improve the structural performance of the frame beam.

As described, the utility walls 501-*a*, 501-*b* may be pre-assembled to include some or all of the components (e.g., insulation 502, electrical conduits, plumbing conduits 509, etc.) as may be needed to support the use of the associated units/rooms. Some or all of these internal components may be substantially enclosed between wall panels or layers 506 that are attached to opposite sides of a wall-frame. The wall panels or layers may be formed of a variety of non-combustible or mineral-based materials, as described herein. As the utility walls 501-*a*, 501-*b* in this example are envelope wall, the exterior sides of the walls 501-*a*, 501-*b* include an exterior finish material 503 (e.g., one or more cladding layers) and the interior sides of the walls 501-*a*, 501-*b* include an interior finish material 505. The interior finish material 505 may be coupled to the interior sides of the walls 501-*a*, 501-*b* using one or more brackets 504, which may be configured to provide the interior finish material 505 in a spaced arrangement with respect to the wall panels 506. The cavity defined between the interior finish material 505 and the interior wall panels 506 may be sized to accommodate portions of the conduits that extend through the wall panels 506, such as to accommodate coupling of the conduits of vertically adjacent utility walls.

In some embodiments, the pair of diaphragm beams discussed previously (e.g., beams 230-2 and 230-1), which support a floor-ceiling panel such as panel 222-3, may be a first pair of diaphragm beams, To define another story of the building, a building assembly according to the examples herein may include at least one second pair of diaphragm beams coupled to the external structural frame at a vertical location above the first pair of diaphragm beams (and correspondingly above a first pair of pre-assembled walls that are supported by the first pair of diaphragm beams). In some embodiments, the pre-assembled utility wall may be tall enough to span more than a singly story, e.g., it may extend from below the first pair of diaphragm beams and corresponding floor-ceiling panels to above the second pair of diaphragm beams and corresponding floor-ceiling panels. For example, as shown in FIG. 8, the utility wall 501-*b* extends below the level of the floor-ceiling panel and is coupled to the lower utility wall 501-*a* at a location below the ceiling side of floor-ceiling panel 222-3. The utility wall 501-*b* at its opposite end may extend beyond the upper floor-ceiling panel (i.e., a floor-ceiling panel vertically above panel 222-3 and not shown in this partial view) and may be coupled to another vertically adjacent utility wall at a location above the floor side of the upper floor-ceiling panel (e.g., at interface 508). The utility walls may be mechanically joined to each floor-ceiling panel the thickness of which they span, for example using brackets 507 and mechanical fasteners. Thus a given utility wall may have such connections to two or more vertically adjacent floor-ceiling panels. To assemble a utility wall to the building, the utility wall may be arranged generally vertically and moved towards the diaphragm and other pre-assembled walls already installed (e.g., one or more demising walls, end walls, etc.) and then fastened to the diaphragm (e.g., to the respective floor-ceiling panels) using an L-shaped or otherwise suitably shaped brackets.

The present disclosure is not to be limited in terms of the particular embodiments described in this application, which are intended as illustrations of various aspects. Many modifications and embodiments can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and embodiments are intended to fall within the scope of the appended claims. The present disclosure includes the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

While the foregoing detailed description has set forth various embodiments of the devices and/or processes via the use of block diagrams, flowcharts, and/or embodiments, such block diagrams, flowcharts, and/or embodiments contain one or more functions and/or operations, it will be understood by those within the art that each function and/or operation within such block diagrams, flowcharts, or embodiments can be implemented, individually and/or collectively, by a wide range of hardware, software, firmware, or virtually any combination thereof.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific embodiments of operably couplable include but are not limited to physically mateable and/or physically interacting components and/or wirelessly interactable and/or wirelessly interacting components and/or logically interacting and/or logically interactable components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A building assembly, comprising:

a diaphragm beam filled with a mineral-based material and having opposite ends connected to an external structural frame of a building;

a pre-assembled floor-ceiling panel adjacent to a vertical side of and coupled to the diaphragm beam; and a pre-assembled wall adjacent to a lower horizontal side of and non-rigidly coupled to the diaphragm beam, wherein:

the diaphragm beam comprises at least one bracket that extends vertically from the lower horizontal side of the diaphragm beam, and the at least one bracket includes a slot to form a non-rigid connection with an upper portion of the pre-assembled wall.

2. The building assembly of claim 1, wherein the diaphragm beam includes at least one reinforcement member embedded in the mineral-based material.

3. The building assembly of claim 2, wherein the diaphragm beam has a rectangular cross section, and wherein the at least one reinforcement member includes at least one elongate metal rod that extends internally along a length of the diaphragm beam.

4. The building assembly of claim 1, wherein a ceiling side of the pre-assembled floor-ceiling panel is above the lower horizontal side of the diaphragm beam.

5. The building assembly of claim 1, wherein a floor side of the pre-assembled floor-ceiling panel is above an upper horizontal side of the diaphragm beam.

6. The building assembly of claim 1, wherein the pre-assembled floor-ceiling panel comprises:

a plurality of joists perpendicular to the diaphragm beam;

a floor panel including at least one metal layer attached to the plurality of joists on a floor side of the pre-assembled floor-ceiling panel; and a ceiling panel including at least one layer comprising mineral-based material attached to the plurality of joists on a ceiling side of the pre-assembled floor-ceiling panel.

7. The building assembly of claim 1, wherein the pre-assembled floor-ceiling panel is one of at least two pre-assembled floor panels, each of which is adjacent to an opposite vertical side of the diaphragm beam.

8. The building assembly of claim 7, wherein each of the at least two pre-assembled floor panels is supported by a horizontally extending bracket attached to a respective vertical side of the diaphragm beam.

9. The building assembly of claim 7, wherein each of the at least two pre-assembled floor panels is coupled to an upper horizontal side of the diaphragm beam.

10. The building assembly of claim 1, wherein the pre-assembled wall is one of at least two pre-assembled walls, each of which is adjacent to an opposite horizontal side of the diaphragm beam.

11. The building assembly of claim 10, wherein each of the at least two pre-assembled walls is a non-loadbearing envelope wall.

12. The building assembly of claim 10, wherein each of the at least two pre-assembled walls is a non-loadbearing interior wall.

13. The building assembly of claim 1, wherein the pre-assembled wall includes:

a plurality of studs that extend perpendicular to the diaphragm beam and a pair of wall panels attached to opposite sides of the studs;

brackets attached to an outer side of at least one of the pair of wall panels and configured to support an interior finish layer in a spaced arrangement from the outer side; and a sprinkler conduit that extends through a cavity defined between the wall panels and that protrudes beyond the outer side of the at least one of the pair of wall panels to which the brackets are attached.

14. The building assembly of claim 13, wherein the pre-assembled wall includes an interior finish layer on each outer side of the pair of wall panels, wherein the outer sides of the pair of wall panels define a first distance therebetween, wherein the first distance is narrower than a width of the diaphragm beam, wherein the interior finish layers define a second distance therebetween, and wherein the second distance is wider than the width of the diaphragm beam.

15. The building assembly of claim 1, wherein the at least one bracket includes at least a first bracket and a second bracket that extend vertically from the lower horizontal side of the diaphragm beam, and wherein each of the at least the first bracket and the second bracket of the diaphragm beam accommodates a corresponding stud of the pre-assembled wall therebetween.

16. The building assembly of claim 1, further comprising a water-impermeable elongate member that covers a vertical side of the diaphragm beam opposite the vertical side to which the pre-assembled floor-ceiling panel is coupled.

17. The building assembly of claim 16, wherein the elongate member covers at least a portion of an upper horizontal side and at least a portion of a lower horizontal side of the diaphragm beam.

18. The building assembly of claim 16, wherein the elongate member comprises an extrusion or a pultrusion formed of a plastic or composite material.

19. The building assembly of claim 1, wherein the pre-assembled wall is a first pre-assembled wall, wherein the building assembly further comprises a second pre-assembled wall coupled perpendicularly to the first pre-assembled wall, and wherein the second pre-assembled wall comprises plumbing conduits.

20. A building assembly, comprising:

a pair of diaphragm beams, wherein each diaphragm beam is filled with a mineral-based material, and wherein each diaphragm beam has opposite ends connected to an external structural frame of a building;

a pre-assembled floor-ceiling panel arranged between and coupled to the pair of diaphragm beams;

a first pre-assembled wall coupled to a horizontal side of a first diaphragm beam of the pair of diaphragm beams, wherein the first pre-assembled wall is an interior wall of the building;

a second pre-assembled wall coupled to an upper or lower horizontal side of a second diaphragm beam of the pair of diaphragm beams, wherein the second pre-assembled wall is an envelope wall of the building; and a water-impermeable elongate member that covers a vertical side of the second diaphragm beam opposite a vertical side to which the pre-assembled floor-ceiling panel is coupled, wherein the elongate member covers at least a portion of the upper horizontal side and at least a portion of the lower horizontal side of the diaphragm beam.

21. The building assembly of claim 20, wherein the pre-assembled floor-ceiling panel is one of a plurality of pre-assembled floor-ceiling panels that extend between the first and second pre-assembled walls.

22. The building assembly of claim 20, further comprising another pre-assembled wall that connects the first and second pre-assembled walls, wherein the another pre-assembled wall includes one or more plumbing conduits.

23. The building assembly of claim 22, wherein the pair of diaphragm beams is a first pair of diaphragm beams, wherein the building assembly further comprises a second pair of diaphragm beams coupled to the external structural frame at a vertical location above the first and second pre-assembled walls, and wherein the another pre-assembled wall extends from below the first pair of diaphragm beams to above the second pair of diaphragm beams.

24. A method to assemble a building system, the method comprising:

coupling opposite ends of a pair of diaphragm beams to an external structural frame of a building, wherein at least one of the pair of diaphragm beams is filled with a mineral-based material;

arranging at least one pre-assembled floor-ceiling panel between the pair of diaphragm beams such that opposite transverse edges of the pre-assembled floor-ceiling panel are adjacent to opposing vertical sides of the pair of diaphragm beams;

coupling the at least one pre-assembled floor-ceiling panel to the opposing vertical sides of the pair of diaphragm beams;

arranging a pre-assembled exterior wall adjacent a lower horizontal side of a first diaphragm beam of the pair of diaphragm beams and coupling the pre-assembled exterior wall to the first diaphragm beam of the pair of diaphragm beams, the floor-ceiling panel, or both; and arranging a pre-assembled interior wall adjacent a lower horizontal side of a second diaphragm beam of the pair of diaphragm beams and non-rigidly coupling the pre-assembled interior wall to the second diaphragm beam, wherein:

the second diaphragm beam comprises at least one bracket that extends vertically from the lower horizontal side of the second diaphragm beam, and the at least one bracket includes a slot to form a non-rigid connection with an upper portion of the pre-assembled interior wall.

25. The method of claim 24, wherein arranging the at least one pre-assembled floor-ceiling panel between the pair of diaphragm beams and coupling the at least one pre-assembled floor-ceiling panel to the opposing vertical sides of the pair of diaphragm beams include:

arranging at least two pre-assembled floor-ceiling panels between the pair of diaphragm beams with transverse edges of the at least two floor-ceiling panels being supported by the pair of diaphragm beams and at least one longitudinal edge of each of the at least two floor-ceiling panels being unsupported by a beam of the external structural frame; and coupling the at least two pre-assembled floor-ceiling panels to one another.

26. The method of claim 24, further comprising covering a vertical side of the first diaphragm beam, opposite the vertical side to which the pre-assembled floor-ceiling panel is coupled, with a water-impermeable elongate member, wherein the elongate member covers at least a portion of an upper horizontal side and at least a portion of the lower horizontal side of the first diaphragm beam.

* * * * *